US008820736B2

(12) United States Patent
Maejima et al.

(10) Patent No.: US 8,820,736 B2
(45) Date of Patent: Sep. 2, 2014

(54) SHEET POST-PROCESSING APPARATUS AND IMAGE FORMATION SYSTEM USING THE APPARATUS

(71) Applicants: Hiroshi Maejima, Yamanashi-ken (JP); Hiroto Akiyama, Yamanashi-ken (JP)

(72) Inventors: Hiroshi Maejima, Yamanashi-ken (JP); Hiroto Akiyama, Yamanashi-ken (JP)

(73) Assignee: Nisca Corporation, Minamikoma-gu, Yamanashi (JP)

( * ) Notice: Subject to any disclaimer, the term of this patent is extended or adjusted under 35 U.S.C. 154(b) by 0 days.

(21) Appl. No.: 13/755,624

(22) Filed: Jan. 31, 2013

(65) Prior Publication Data

US 2014/0042695 A1 Feb. 13, 2014

(30) Foreign Application Priority Data

Feb. 1, 2012 (JP) ..... 2012-019971
Feb. 1, 2012 (JP) ..... 2012-019972
Feb. 1, 2012 (JP) ..... 2012-019973

(51) Int. Cl.

| | |
|---|---|
| ***B65H 31/36*** | (2006.01) |
| ***B65H 31/00*** | (2006.01) |
| ***B65H 31/38*** | (2006.01) |
| ***B65H 31/30*** | (2006.01) |
| ***B65H 31/10*** | (2006.01) |
| ***B65H 29/34*** | (2006.01) |
| ***B65H 31/34*** | (2006.01) |
| ***B65H 29/14*** | (2006.01) |
| ***B65H 31/20*** | (2006.01) |

(52) U.S. Cl.

CPC ..... *B65H 29/14* (2013.01); *B65H 31/38* (2013.01); *B65H 2404/166* (2013.01); *B65H 31/3027* (2013.01); *B65H 2553/83* (2013.01); *B65H 2404/1523* (2013.01); *B65H 2553/612* (2013.01); *B65H 31/10* (2013.01); *B65H 29/34* (2013.01); *B65H 2801/27* (2013.01); *B65H 31/34* (2013.01); *B65H 2404/232* (2013.01); *B65H 2404/1521* (2013.01); *B65H 2404/731* (2013.01); *B65H 2301/4212* (2013.01); *B65H 31/20* (2013.01); *B65H 2301/4213* (2013.01); *B65H 2404/742* (2013.01)

USPC ..... 271/221; 271/207; 271/213

(58) Field of Classification Search

USPC ..... 271/220, 221, 213, 218, 207

See application file for complete search history.

(56) References Cited

U.S. PATENT DOCUMENTS 5,120,047 A * 6/1992 Mandel et al. ..... 271/220
7,530,565 B2 * 5/2009 Terao et al. ..... 271/207

FOREIGN PATENT DOCUMENTS

JP 2007-308215 A 11/2007
JP 2011-037591 A 2/2011

* cited by examiner

*Primary Examiner* — Luis A Gonzalez
(74) *Attorney, Agent, or Firm* — Manabu Kanesaka

(57) ABSTRACT

To provide a post-processing apparatus for preventing a sheet from becoming misaligned in dropping the rear end side of the sheet carried in a processing tray from a sheet discharge path to store on the tray, and enabling the mechanism to be simplified, compact and configured at low cost, a sheet guide that guides a sheet from the sheet discharge path to the processing tray is comprised of a pair of right and left guide members, at the same time in the processing tray are disposed a pair of right and left side edge alignment members, and each guide member and each side edge alignment member are configured to shift to positions in the sheet width direction in an integral manner using a common drive motor.

11 Claims, 16 Drawing Sheets

FIG. 7A SHEET CARRY-IN
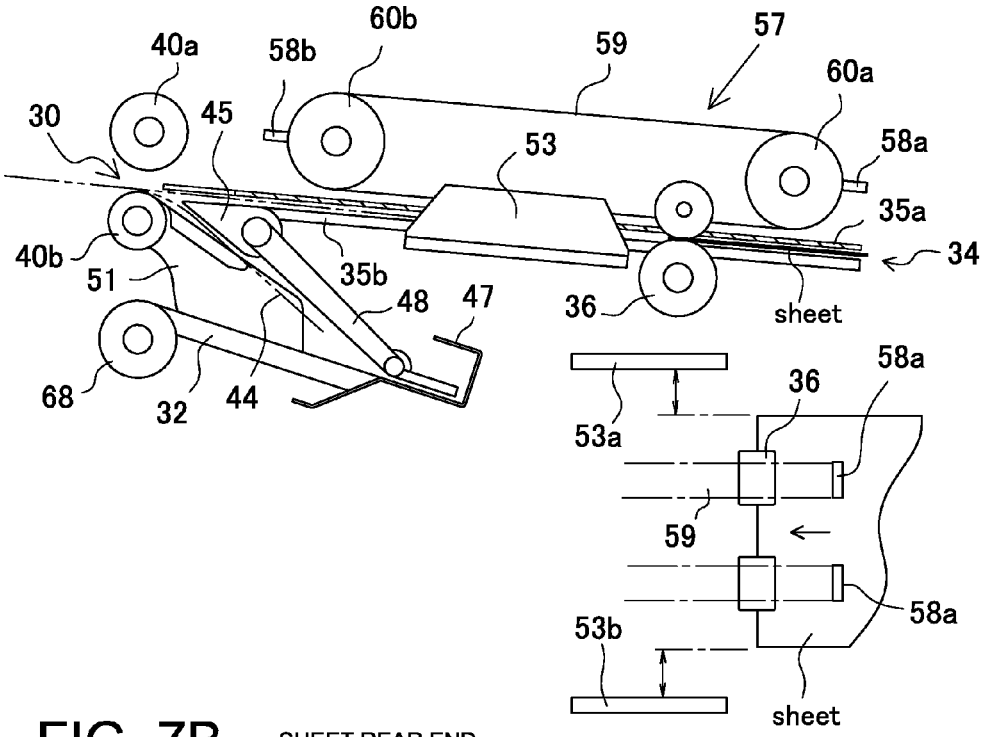
FIG. 7B SHEET REAR END
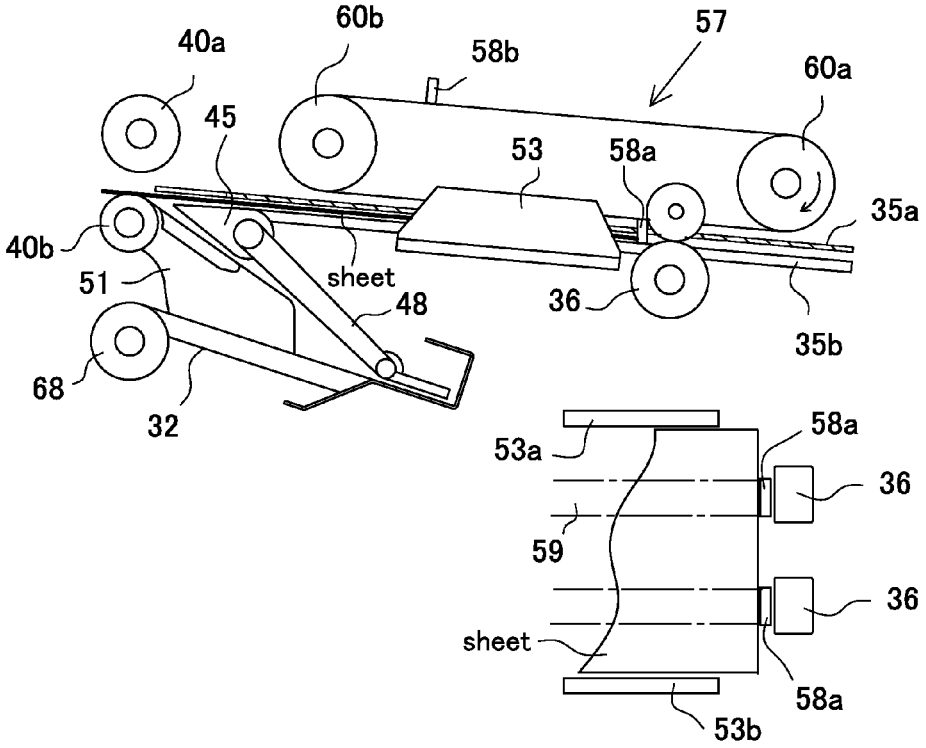

TRAY SHEET DISCHARGE

COLLECTION ON PROCESSING TRAY

FIG. 9E
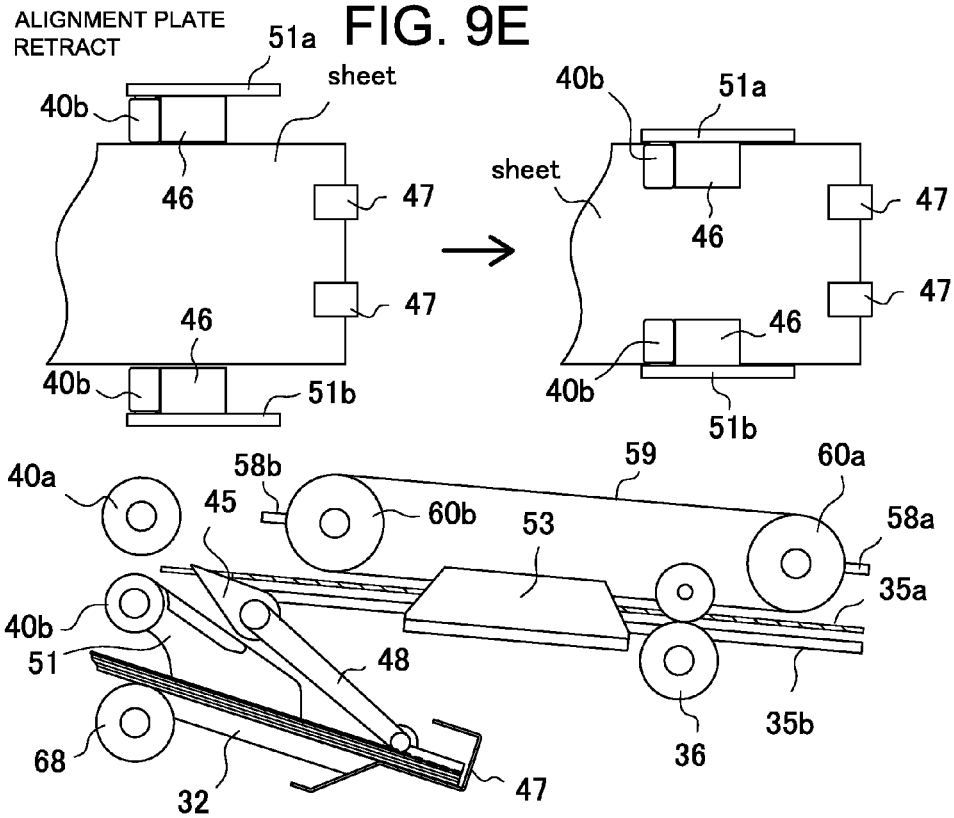
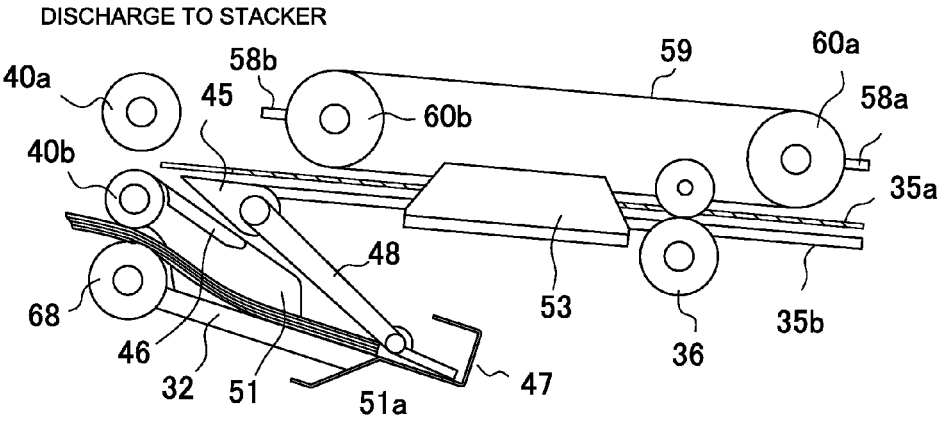
FIG. 9F
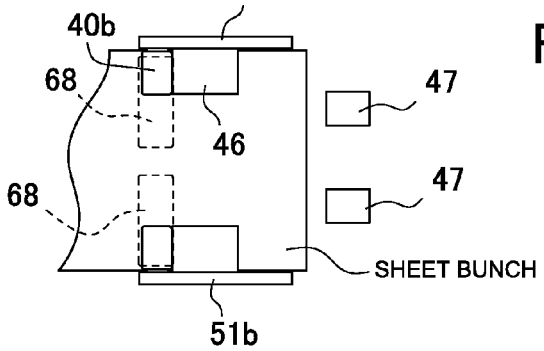

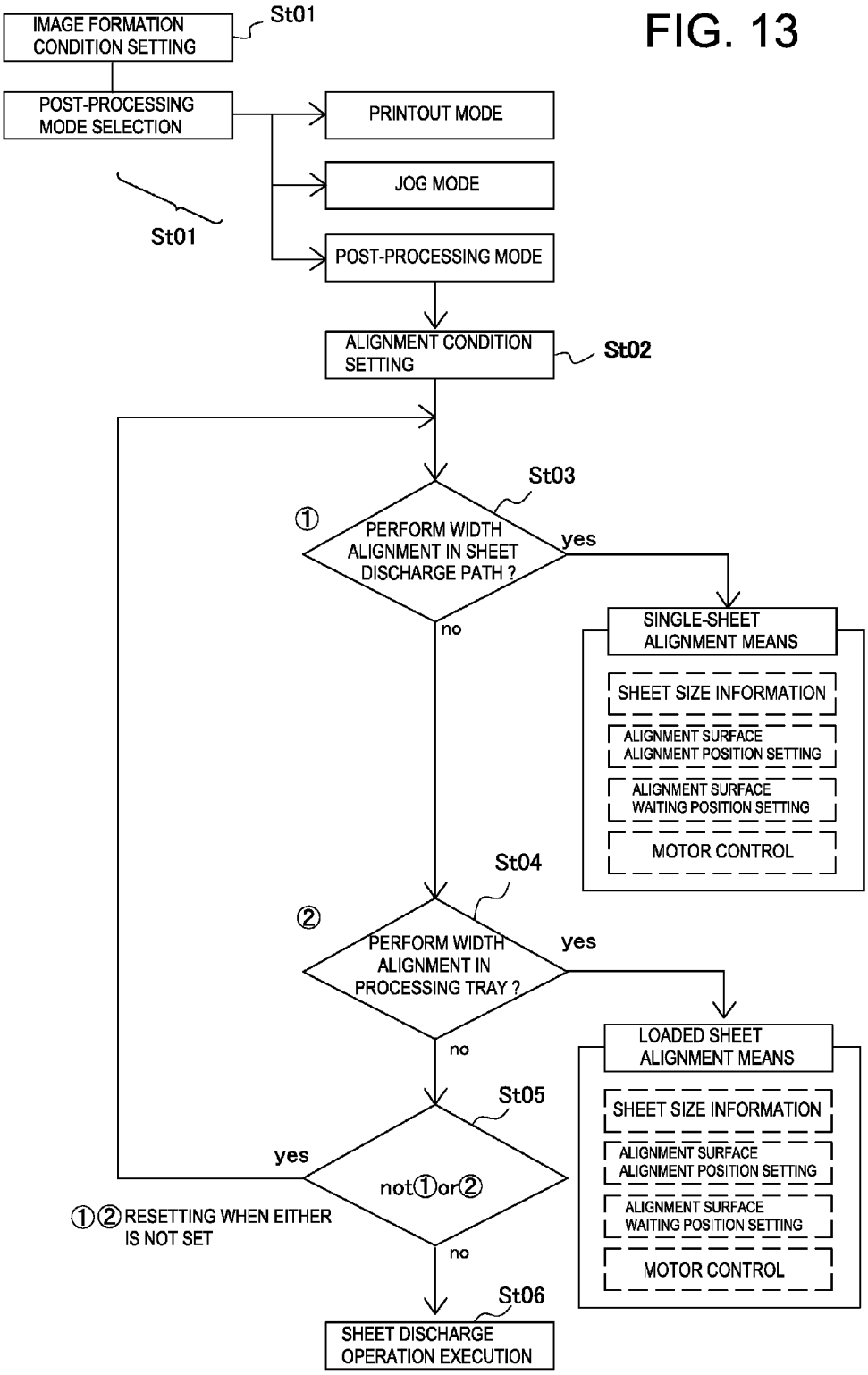
FIG. 13
IMAGE FORMATION CONDITION SETTING
St01
POST-PROCESSING MODE SELECTION
PRINTOUT MODE
JOG MODE
POST-PROCESSING MODE
St01
ALIGNMENT CONDITION SETTING
St02
St03
①
PERFORM WIDTH ALIGNMENT IN SHEET DISCHARGE PATH ?
yes
no
SINGLE-SHEET ALIGNMENT MEANS
SHEET SIZE INFORMATION
ALIGNMENT SURFACE ALIGNMENT POSITION SETTING
ALIGNMENT SURFACE WAITING POSITION SETTING
MOTOR CONTROL
St04
②
PERFORM WIDTH ALIGNMENT IN PROCESSING TRAY ?
yes
no
LOADED SHEET ALIGNMENT MEANS
SHEET SIZE INFORMATION
ALIGNMENT SURFACE ALIGNMENT POSITION SETTING
ALIGNMENT SURFACE WAITING POSITION SETTING
MOTOR CONTROL
St05
yes
not①or②
①②RESETTING WHEN EITHER IS NOT SET
no
St06
SHEET DISCHARGE OPERATION EXECUTION

SHEET POST-PROCESSING APPARATUS AND IMAGE FORMATION SYSTEM USING THE APPARATUS

BACKGROUND OF THE INVENTION

The present invention relates to a sheet post-processing apparatus for feeding an image-formed sheet to a processing tray to perform post-processing, and then storing the sheet in a stack tray, and more particularly, improvements in a sheet transport mechanism for feeding and setting a sheet in a processing position on the processing tray with a correct posture.

Generally, this kind of post-processing apparatus is known as an apparatus which is connected to a sheet discharge outlet of an image formation apparatus, collates and collects image-formed sheets on a processing tray to perform post-processing such as binding processing, punching processing and stamping processing, and stores the processed sheets in a stack tray.

For example, Patent Document 1 discloses an apparatus which transports backward a sheet fed from an image formation apparatus to a processing tray disposed below a sheet discharge outlet, performs binding processing with a post-processing apparatus such as a stapler apparatus disposed in the tray, and stores the binding-processed sheets in a stack tray on the downstream side.

In the Document, a sheet discharge area is provided inside a housing of the image formation apparatus, and disclosed is the post-processing apparatus of inner finisher structure such that a post-processing unit is inserted in the sheet discharge area.

Further, Patent Document 2 discloses a mechanism which collects a subsequent sheet in a buffer path until the processing is finished during operation of the post-processing of a preceding sheet among sheets that are transported at high velocity from an image formation apparatus, aligns the sheet posture in the path, and then drops onto a downward processing tray to store.

[Patent Document 1] Japanese Patent Application Publication No. 2011-037591

[Patent Document 2] Japanese Patent Application Publication No. 2007-308215

Various kinds are known as the post-processing mechanism which transports a sheet fed from the image formation apparatus to the processing tray to perform post-processing, and then stores in the stack tray as described above. In the apparatus of Patent Document 1 as described previously, the processing tray is disposed with a height difference formed below a sheet discharge path, the transport direction is reversed from the sheet discharge path, and the sheet is carried in the processing tray from the rear end side. Then, the sheet that is carried onto the tray is positioned and aligned in the front and back in the sheet discharge direction and the left and right in the sheet-discharge orthogonal direction to reference positions, and therefore, it is difficult to find a correct processing position.

Then, the inventor of the present invention arrived at the idea of positioning the sheet front end in a regulation position (for example, sheet stopper) on the tray in feeding the sheet to the processing tray form the sheet discharge path, and then, causing the sheet rear end side to make a soft landing on the tray. At this point, the need arises for retracting a guide member that guides the sheet underside to carry the sheet front end in the tray and a sheet discharge roller brought into contact with the sheet underside to lateral positions away from the sheet, and dropping the sheet rear end side. However, it has a problem with space providing a retract mechanism for retracting a plurality of members inside limited space of the sheet discharge path and processing tray, and at the same, the problem arises that maintenance space when trouble occurs is not obtained.

It is an object of the present invention to provide a post-processing apparatus for preventing a sheet from becoming misaligned in dropping the rear end side of the sheet with the front end carried in the processing tray from the sheet discharge path to store on the tray, and enabling the mechanism to be simplified, compact and configured at low cost.

SUMMARY OF THE INVENTION

To achieve the above-mentioned object, the invention is characterized in that a sheet guide that guides a sheet from the sheet discharge path to the processing tray is comprised of a pair of right and left guide members, at the same time in the processing tray are disposed a pair of right and left side edge alignment members, and that each guide member and each side edge alignment member are configured to shift to positions in the sheet width direction in an integral manner using a common drive motor.

The configuration will be described specifically. Provided are a sheet discharge path having a carry-in entrance and a sheet discharge outlet, a transport roller disposed in the sheet discharge path, a processing tray disposed below the sheet discharge outlet with a height difference formed, a back transport path for reversing the transport direction of a sheet to transport from the sheet discharge path to the processing tray, sheet discharge rollers disposed in the sheet discharge outlet to carry the sheet fed from the carry-in entrance to the back transport path, a sheet guide means having a guide surface for guiding the sheet fed by the sheet discharge rollers to the processing tray so as to form the back transport path, a post-processing means disposed in the processing tray, and a sheet side edge alignment means, disposed in the processing tray, having an alignment surface for the sheet side edge to align the width-direction position of the sheet with a beforehand set reference line.

The sheet guide means is comprised of a pair of right and left guide members capable of shifting to positions in the carry orthogonal direction of the sheet carried to the processing tray, and a guide shift means for shifting positions of the pair of right and left guide members, and the sheet side edge alignment means is comprised of a pair of right and left side edge alignment members capable of shifting to positions in the sheet-discharge orthogonal direction of the sheet, and an alignment shift means for shifting positions of the pair of right and left side edge alignment members. The guide shift means and the alignment shift means are configured to shift the guide members and the side edge alignment members to positions in the sheet-discharge orthogonal direction in an integral manner with a common drive motor.

In addition, a control means is provided to control the sheet discharge rollers, sheet guide means and sheet side edge alignment means, and is configured to control the sheet guide means and sheet side edge alignment means so that the lateral distance is increased in order of an alignment position, guide position and retracted position in pairs of right and left guide members and side edge alignment members. In this case, the alignment position and the guide position are set at either the same position or different positions a distance away. In other words, the positions are disposed so that alignment position≥guide position>retracted position.

The invention is to form the sheet guide that guides a sheet from the sheet discharge path to the processing tray using a pair of right and left guide members, and shift each guide member to positions in the sheet width direction in an integral manner with the drive motor common to a pair of right and left side edge alignment members disposed in the processing tray, and therefore, has the following effects.

In feeding a sheet from the sheet discharge path to the downward processing tray, the guide members for guiding the sheet underside and the side edge alignment members for aligning the width direction of the sheet on the tray are configured to shift and reciprocate in an integral manner with the common drive motor, and therefore, it is possible to make the apparatus small and compact as compared with the case of adopting the mechanism for shifting the plurality of members individually. Further, even when trouble such as a sheet jam occurs in the sheet discharge path, back transport path or processing tray, since the reciprocate mechanism is simple, maintenance space is not required, and recovery work is easy.

Further, in the invention, by integrally forming the side edge alignment member and guide member using a resin or the like, there is no fear that the guide position and the alignment position become mutually misaligned as compared with the case of configuring the members individually, and it is possible to carry the sheet onto the processing tray smoothly. Concurrently therewith, by integrally forming a roller holder in the guide member to hold the sheet discharge roller in contact with the sheet underside, it is possible to cause the sheet discharge roller, sheet guide and side edge engagement member to reciprocate smoothly without rattling.

BRIEF DESCRIPTION OF DRAWINGS

FIG. 6A shows a plan configuration, and FIG. 6B shows an elevation configuration;

FIGS. 7A and 7B show operating states of the sheet discharge mechanism of FIG. 2, where FIG. 7A shows an initial state in which a sheet enters the sheet discharge path, and FIG. 7B shows a state in which the sheet rear end is released from a transport roller;

FIG. 8C shows a state in which the sheet rear end is guided from the sheet discharge path to a back transport path, and FIG. 8D shows a state in which the sheet rear end strikes a rear end regulation member on the tray;

FIGS. 9E and 9F show operating states of the sheet discharge mechanism of FIG. 2, where FIG. 9E shows a state in which the sheet discharge roller and divider guide are retracted from sheet engagement positions to lateral positions, and FIG. 9F shows a state in which a sheet bunch that is stapled and bound is nipped between a carrying-out roller and sheet discharge roller to carry out to a stack tray after post-processing operation;

FIG. 13 is an explanatory view illustrating an operation program of a control means in the control configuration of FIG. 12;

DETAILED DESCRIPTION OF PREFERRED EMBODIMENTS

Figure 1:
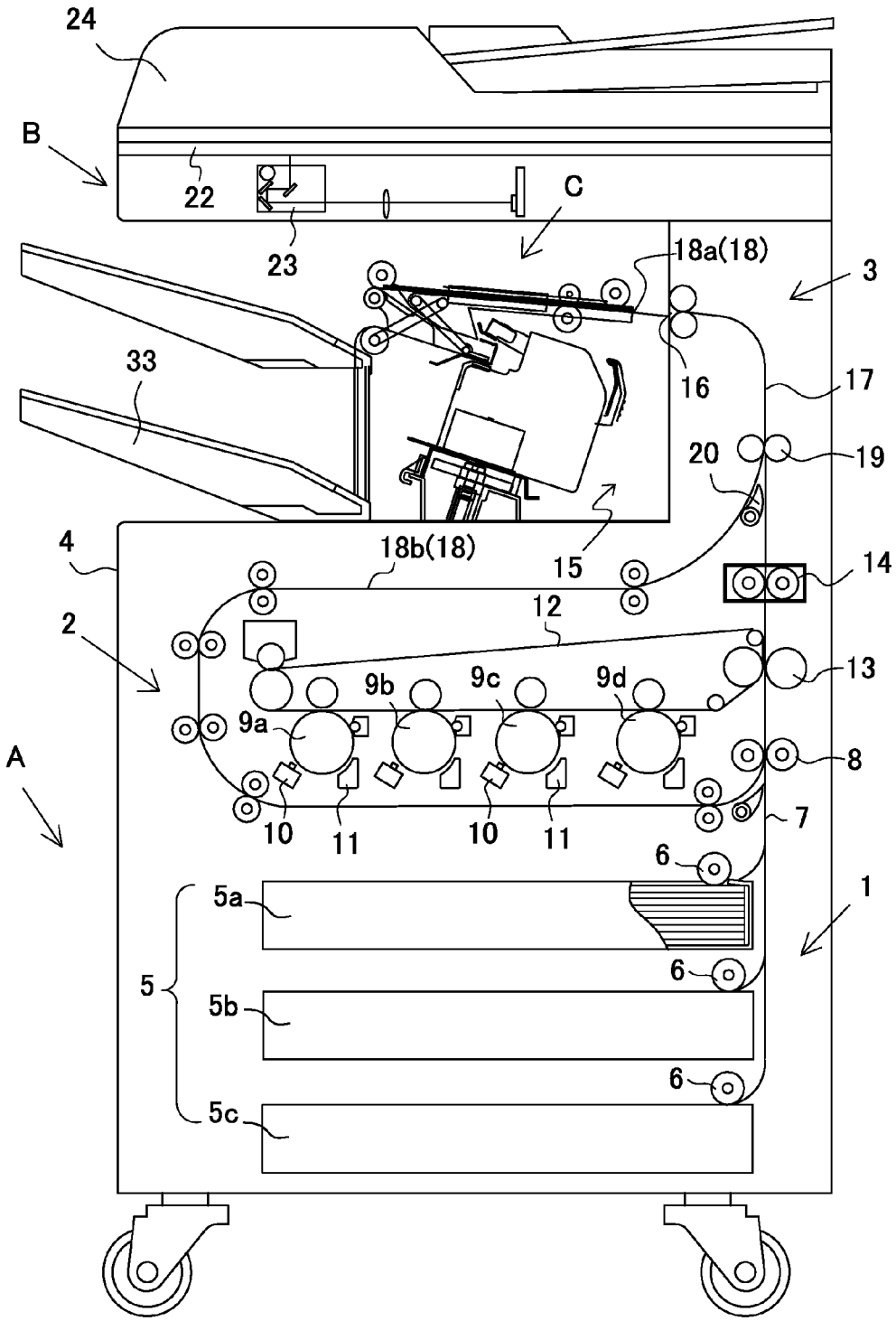
FIG. 1 is an entire configuration explanatory view of an image formation system according to the invention.

The present invention will specifically be described below according to preferred Embodiments shown in drawings. FIG. 1 shows an image formation system according to the invention. This system is comprised of an image formation unit A, image read unit B and post-processing unit C. Then, the image read unit B reads an original image, and based on the image data, the image formation unit A forms the image on a sheet. Then, the post-processing unit C performs finish processing such as binding processing on image-formed sheets.

The post-processing unit C shown in the figure is inserted in a sheet discharge area 15 of the image formation unit A, and is configured as an apparatus which collates and collects image-formed sheets to perform binding processing. Further, the image read unit B is mounted above the image formation unit A, and the post-processing unit C is disposed in between both units.

Alternatively, it is also possible to configure the image formation unit A, image read unit B and post-processing unit C in standalone structure independently of one another and make a system by connecting between apparatuses with network cables. In this case, a carry-in entrance 34 of the post-processing unit C is coupled to a sheet discharge outlet 16 of the image formation unit A. The image formation unit A, image read unit B and post-processing unit C as shown in FIG. 1 will be described below in this order.

[Image Formation Unit]

As shown in FIG. 1, the image formation unit A is comprised of a paper feed section 1, image formation section 2, sheet discharge section 3 and signal processing section (not shown), and is incorporated into an apparatus housing 4. The paper feed section 1 is comprised of a cassette 5 that stores sheets, and the section 1 shown in the figure is comprised of a plurality of cassettes 5*a*, 5*b*, 5*c*, and is configured to be able to store sheets of different sizes. Into each of the cassettes 5*a* to 5*c* are incorporated a paper feed roller 6 that feeds out the sheet, and separation means (separation hook, separation roller, etc.; not shown) for separating sheets on a sheet-by-sheet basis.

Further, the paper feed section 1 is provided with a paper feed path 7 to feed a sheet from each cassette 5 to the image formation section 2. A register roller pair 8 is provided at the path end of the paper feed path 7 to align the front end of the sheet fed from each cassette 5, while causing the sheet to wait corresponding to image formation timing of the image formation section 2.

Thus, the paper feed section 1 is comprised of a plurality of cassettes according to apparatus specifications, and is configured to feed sheets of a size selected in a control section to the image formation section 2 on the downstream side. Each cassette 5 is inserted in the apparatus housing 4 to be detachable and attachable so as to enable sheets to be supplied.

As the image formation section 2, it is possible to adopt various image formation mechanisms that form an image on a sheet. The section shown in the figure indicates an electrostatic type image formation mechanism. As shown in FIG. 1, a plurality of drums 9 each comprised of a photoconductor is disposed in the apparatus housing 4 corresponding to color components. In each of the drums 9*a*, 9*b*, 9*c*, 9*d* are disposed an emitter (laser head or the like) 10 and developing device 11. Then, the emitter 10 forms a latent image (electrostatic image) on each drum 9, and the developing device 11 adds toner ink. The ink image added onto each drum 9 is transferred to a transfer belt 12 for each color component, and the image is synthesized.

The transfer image formed on the belt is transferred to the sheet fed from the paper feed section 1 by a charger 13, is fused by a fuser (heat roller) 14, and then is fed to the sheet discharge section 3.

The sheet discharge section 3 is comprised of the sheet discharge outlet 16 formed in the apparatus housing 4 to carry out the sheet to the sheet discharge area 15, and a sheet discharge path 17 to guide the sheet from the image formation section 2 to the sheet discharge outlet. In addition, a duplex path 18, described later, is connected to the sheet discharge section 3 to reverse the side of the sheet with the image formed on the frontside so as to feed again to the image formation section 2.

[Duplex Path]

The duplex path 18 reverses the side of the sheet with the image formed on the frontside in the image formation section 2 to feed again to the image formation section 2. Then, the image is formed on the backside in the image formation section 2, and then, the sheet is carried out of the sheet discharge outlet 16. Therefore, the duplex path 18 is comprised of a switchback path 18*a* for reversing the transport direction of the sheet fed from the image formation section 2 to return to the inside of the apparatus, and a U-turn path 18*b* for reversing the side of the sheet that is returned to the inside of the apparatus. The apparatus shown in the figure is characterized in that the switchback path 18*a* is formed in a sheet discharge path 31 of the post-processing unit C.

By this means, it is not necessary to individually form the path (sheet discharge path 17) for transporting the sheet from the sheet discharge outlet 16 to the post-processing unit C and the path (switchback path 18*a*) for reversing the transport direction of the sheet to reverse the side. In addition, to distinguish between the sheet discharge outlet 30 and sheet discharge path 31 of the post-processing unit C, described later, and the sheet discharge outlet 16 and sheet discharge path 17 of the image formation unit A, the sheet discharge outlet of the image formation unit A is referred to as the main-body sheet discharge outlet 16, and the sheet discharge path thereof is referred to as the main-body sheet discharge path 17.

As shown in the FIG. 1, the main-body sheet discharge path 17 for transporting the sheet from the image formation section 2 to the main-body sheet discharge outlet 16 is approximately linear and is disposed in the vertical direction. The fuser 14 is disposed in an entrance-side end portion of the path. In the main-body sheet discharge path 17, transport rollers that transport the sheet are disposed in appropriate points, and a transport roller 19 shown in the figure is coupled to a drive motor, not shown, to be rotatable forward and backward. Accordingly, by forward and backward rotation of the drive motor, the sheet is carried in the sheet discharge direction and the carry-in direction in the sheet discharge path, respectively.

Inside the apparatus housing is disposed the U-turn path 18*b* that branches off from the main-body sheet discharge path 17 and that reverses the side of the sheet to guide the sheet to the register roller pair 8 of the image formation section 2. Then, the sheet is guided to the U-turn path 18*b* from the main-body sheet discharge path 17 by a path switch means 20, and then, is guided to the image formation section 2 after being reversed. In the U-turn path 18*b* are disposed a plurality of transport roller pairs at predetermined intervals.

[Image Read Unit]

The image read unit B is comprised of a platen 22, and a read carriage 23 that reciprocates along the platen. The platen 22 is formed of transparent glass, and is comprised of a stationary image read surface that scans a stationary image by the shift of the read carriage 23, and a running image read surface that reads an original document image running at predetermined velocity.

The read carriage 23 is comprised of a light source lamp, reflecting mirror that changes reflected light from the original document, and photoelectric converter (not shown). The photoelectric converter is comprised of a line sensor arranged in the original document width direction (main scanning direction) on the platen, and the read carriage 23 reciprocates and shifts in the sub-scanning direction orthogonal thereto, and reads the original document image line-sequentially. Further, an automatic document feeder 24 that causes the original document to run at predetermined velocity is mounted above the running image read surface of the platen 22. The automatic document feeder 24 is comprised of a feeder mechanism for feeding original document sheets set on the paper feed tray to the platen on a sheet-by-sheet basis, and storing the sheet in a sheet discharge tray after reading the image.

[Post-Processing Unit]

Figure 2:
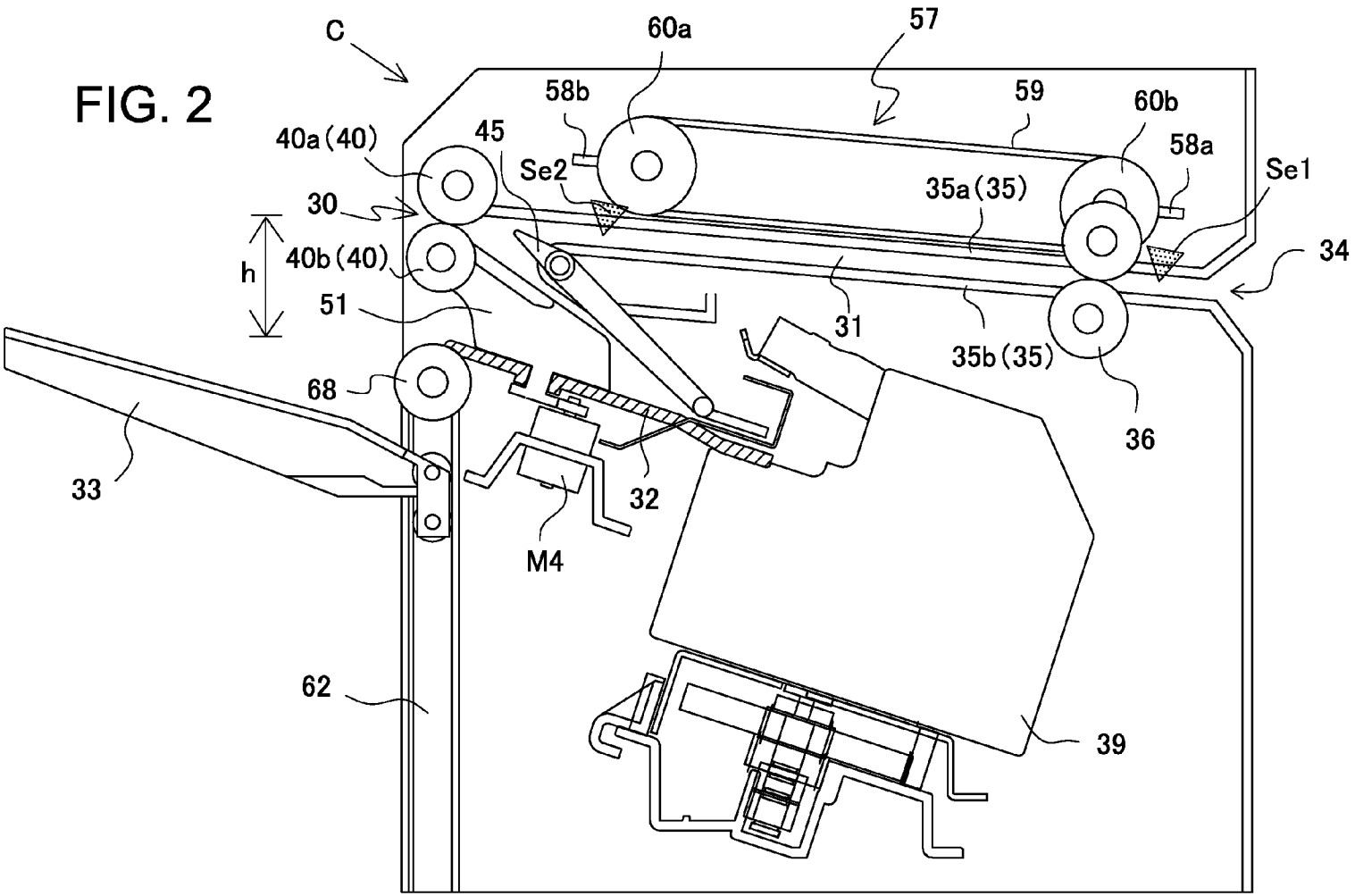
FIG. 2 is an explanatory view of principal part of a post-processing apparatus C in the system of FIG. 1.

The post-processing unit C performs post-processing on the sheet fed from the image formation unit A to store in a stack tray 33. FIG. 2 shows the entire configuration of the post-processing unit C. An apparatus with the post-processing unit C inserted as an option is incorporated into the sheet discharge area 15 provided in the image formation unit A. The post-processing unit C is configured to collate and collect sheets fed to the main-body sheet discharge outlet 16 of the image formation unit A to perform binding processing, and then, store in the stack tray 33.

Therefore, the post-processing unit C is comprised of the sheet discharge path 31 having the sheet discharge outlet 30, a processing tray 32 for collecting sheets to perform binding processing, and the stack tray 33 for storing the binding-processed sheet bunch. The sheet discharge path 31 shown in the figure is comprised of a carry-in entrance 34 continued to the main-body sheet discharge outlet 16, a path guide 35 (path guide member; the same in the following description) that guides a sheet to the sheet discharge outlet 30, and a transport roller 36 disposed in the path. The path guide 35 forms a path to transport a sheet with an upper guide member 35*a* and lower guide member 35*b*. Se1 shown in the figure is a carry-in sensor, and Se2 is a sheet discharge sensor.

[Sheet Discharge Path]

The sheet discharge path 31 and processing tray 32 are disposed vertically at a height difference h away so that the path is positioned upward and that the tray is positioned downward. Then, sheet discharge rollers 40 are disposed in the sheet discharge outlet 30, and transport the sheet fed from the carry-in entrance 34 to the processing tray 32. The sheet discharge rollers 40 are comprised of forward/backward rotation rollers as described above, and reverse the transport direction of the sheet to carry in the processing tray 32 from the sheet discharge path 31. In the processing tray 32 are disposed a loaded sheet alignment means 38 for collating and collecting sheets to position in a predetermined position, and a post-processing means (staple binding apparatus) 39.

The stack tray 33 is disposed on the downstream side of the processing tray 32, and both trays are disposed in almost the same height positions so as to bridge-support the sheet fed from the sheet discharge outlet 30 at the rear end by the processing tray 32 and at the front end portion by the stack tray 33. By the processing tray 32 and stack tray 33 thus respectively bearing the rear end side and front end side of the sheet to support, it is possible to make the apparatus small and compact.

<Sheet Discharge Roller>

The sheet discharge rollers 40 are disposed in the sheet discharge outlet 30 of the sheet discharge path 31. The rollers are comprised of sheet discharge rollers 40 capable of rotating forward and backward so as to carry the sheet front end fed from the carry-in entrance 34 out of the sheet discharge outlet 30, and then, reverse the transport direction to transport backward to the processing tray 32. The sheet discharge rollers 40 are comprised of first rollers 40*a* that engage in the upper side of the sheet that is carried out of the sheet discharge outlet 30, and sheet discharge second rollers 40*b* that engage in the sheet underside, and the sheet discharge first rollers 40*a* are coupled to a forward/backward motor M1 (not shown).

<Sheet Discharge First Roller>

Figure 4:
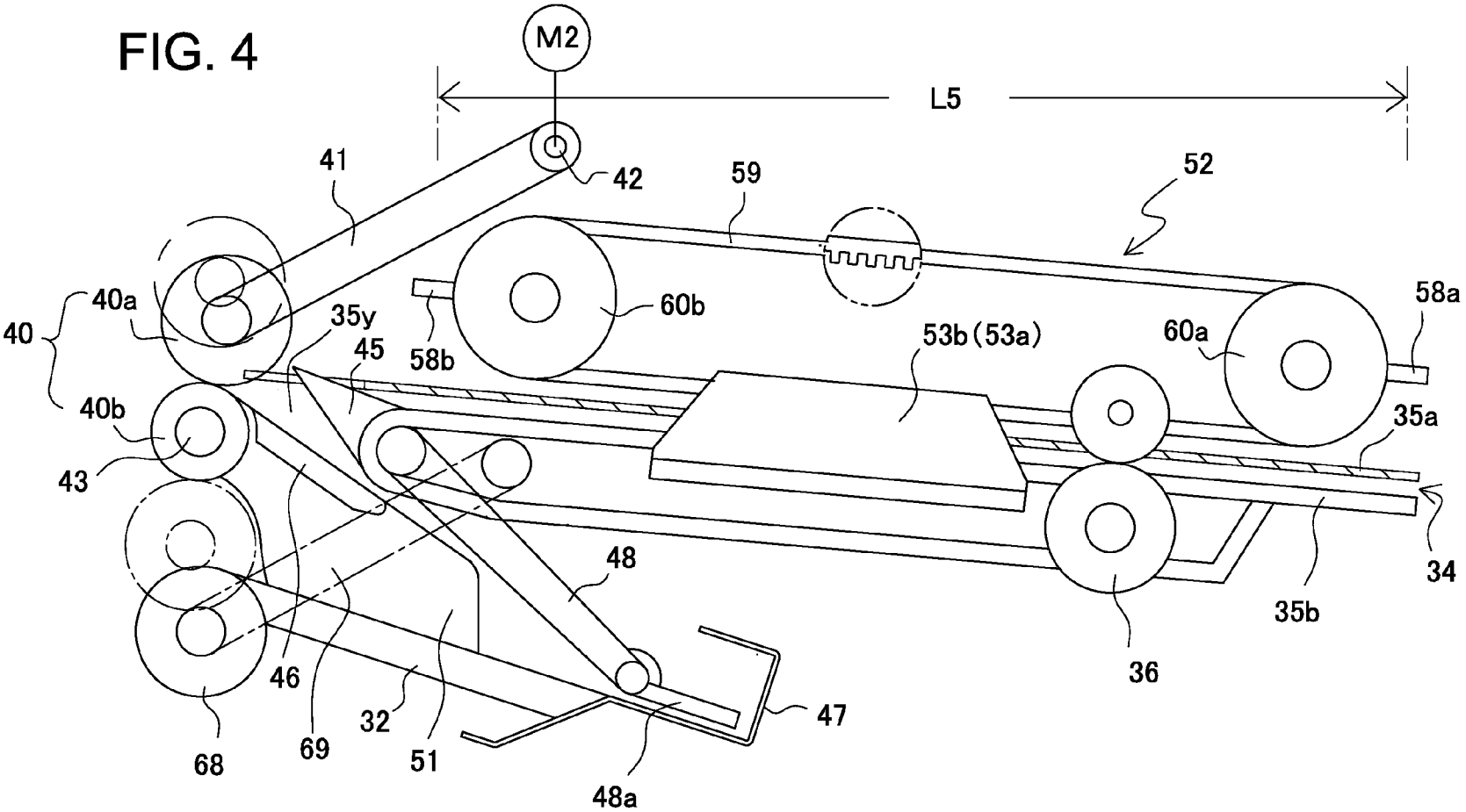
FIG. 4 is an explanatory view of a detailed configuration of the sheet discharge mechanism of the post-processing apparatus of FIG. 2.

The sheet discharge first rollers 40*a* engage in the sheet upper side, are positioned above the sheet fed through the sheet discharge path 31, and are comprised of rollers capable of moving up and down to come into press-contact and separate with/from the sheet discharge second rollers 40*b*. Hereinafter, the sheet discharge first roller 40*a* is referred to as a sheet discharge first roller, and an up-and-down mechanism thereof will be described according to FIG. 4. As shown in FIG. 4, an up-and-down arm 41 is provided in the apparatus frame to be swingable, and the sheet discharge first rollers 40*a* are axially supported by the arm front end. Then, an up-and-down motor (shift motor) M2 is coupled to a base end portion of the up-and-down arm 41, and by forward and backward rotation thereof, the sheet discharge first rollers 40*a* move up and down between actuation positions (solid-line position in FIG. 4) for coming into press-contact with the sheet discharge second rollers 40*b* and waiting positions (dashed-line state in FIG. 4) separated from therefrom.

An example of the up-and-down mechanism will be described. The rotatory shaft (not shown) of the up-and-down motor M2 and the spindle of the up-and-down arm 42 are coupled with a spring clutch. Then, when the up-and-down motor M2 rotates in one direction, the spring clutch is loosened, and the spindle 42 of the up-and-down arm shifts the up-and-down arm 42 from the waiting position to the actuation position. Further, by backward rotation of the up-and-down motor M2, the spring clutch contracts, and the up-and-down arm 41 shifts from the actuation position to the waiting position, and thereafter, strikes a stopper, not shown, to be held in the position.

Further, the spindle 42 of the up-and-down arm is provided with a pulley coupled to the up-and-down motor M2, and the pulley and roller shaft are interlocked with a belt or the like so as to transfer rotation of the motor to the sheet discharge first rollers 40*a*. Moreover, although described is the case of swinging the up-and-down arm 41 up and down with the motor, the arm may be swung with an actuator such as an actuation solenoid.

In such a configuration, by rotating the up-and-down motor M2 forward and backward, the sheet discharge first roller 40*a* is capable of shifting between the waiting position retracted from the sheet transport path (sheet discharge path), and the actuation position for coming into press-contact with the sheet discharge second roller 40*b* with the sheet therebetween. Accordingly, in the waiting position, the sheet carried out to the sheet discharge outlet 30 becomes a free state without being restrained by the rollers, and in the actuation position, the sheet is transported in the rotation direction of the rollers while being held by the rollers.

<Sheet Discharge Second Roller>

The sheet discharge second rollers 40*b* are disposed in positions for engaging in the first sheet discharge rollers 40*a*, and are comprised of idle rollers that follow rotation of the sheet discharge first rollers 40*a*. The sheet discharge second rollers 40*b* are configured to retract from the shift trajectory (path) of the sheet, as described later. Hereinafter, the sheet discharge second roller 40*b* is referred to as a sheet discharge second roller, and is comprised of the roller that engages in the periphery of the sheet discharge first roller 40*a*, and a shaft pin 43 that axially supports the roller to be rotatable, and the shaft pin 43 is embedded in an alignment member (loaded sheet alignment means, described later) 51, described later. In addition, the sheet discharge second roller 40*b* shown in the figure is a roller of resin such as Delrin, and is configured to be light.

[Back Transport Path]

The sheet discharge path 31 is provided with a back transport path 44 for carrying the sheet with the front end portion carried out to the sheet discharge outlet 30 in the processing tray 32 from the rear end. As shown in FIG. 4, the path guide 35 forming the sheet discharge path 31 is provided with a branch portion 35*y* (branch portion of the sheet discharge path), and the back transport path 44 is disposed to carry out the sheet from the branch portion 35*y* onto the processing tray. A path switch means 45 is provided in the branch portion 35*y*, and guides the sheet rear end to the processing tray side in the state of FIG. 4 after the sheet rear end passes through the branch portion 35*y*. The path switch means 45 shown in the figure is configured to switch the path direction by an actuation means M3 common to a sheet press means 48, described later.

Further, as shown in FIG. 4, the back transport path 44 is of guide structure such that divider guide members 46 separate from sheets loaded on the processing tray. This is because of avoiding causing the loaded sheets that are already loaded and the carried-in sheet to mutually rubbing in carrying the sheet from the branch portion 35*y* onto the processing tray. Accordingly, the divider guide member 46 is made of a resin plate as shown in the figure, and alternatively, may be configured by hanging a resin film (for example, Mylar sheet).

[Configuration of the Processing Tray]

The configuration of the processing tray 32 will be described according to FIG. 2. As described previously, the processing tray 32 is disposed below the sheet discharge path 31, and is disposed at a distance to form the height difference h from the sheet discharge outlet 30. The stack tray 33 is disposed on the downstream side of the processing tray 32, and the sheet fed from the sheet discharge outlet 30 by the back transport path 44 is bridge-supported between both trays. The post-processing means 39 performs the post-processing in this state, and then, stores in the stack tray 33.

<Sheet End Regulation Means>

In the processing tray 32 are disposed a rear end regulation means 47 for striking the sheet rear end against the post-processing apparatus together with the post-processing means 39 to regulate, and the loaded sheet alignment means 38 for aligning the width direction of sheets loaded on the processing tray to a reference position. The rear end regulation means 47 is comprised of stopper members that are disposed at the end edge of the processing tray 32 and that strike the sheet to the processing position of the post-processing means (staple binding apparatus) 39 to regulate. The stopper members shown in the figure are disposed in right and left areas, and are attached to the apparatus frame to be able to shift in conjunction with the staple binding apparatus that shifts in the sheet width direction.

<Sheet Press Means>

In the processing tray 32 is disposed the sheet press means 48 for pressing the front endportion (rear endportion in the sheet discharge direction) fed from the back transport path 44. The sheet press means 48 presses the front end portion of the sheet that is transported backward from the sheet discharge path 31 onto the processing tray from above the processing tray, and thereby holds the posture of the sheet. Thus holding the posture prevents the sheet posture from fluctuating in dropping the rear end portion of the sheet with the front end portion struck and regulated against the rear end regulation means 47 from the divider guides 46.

Figure 10A:
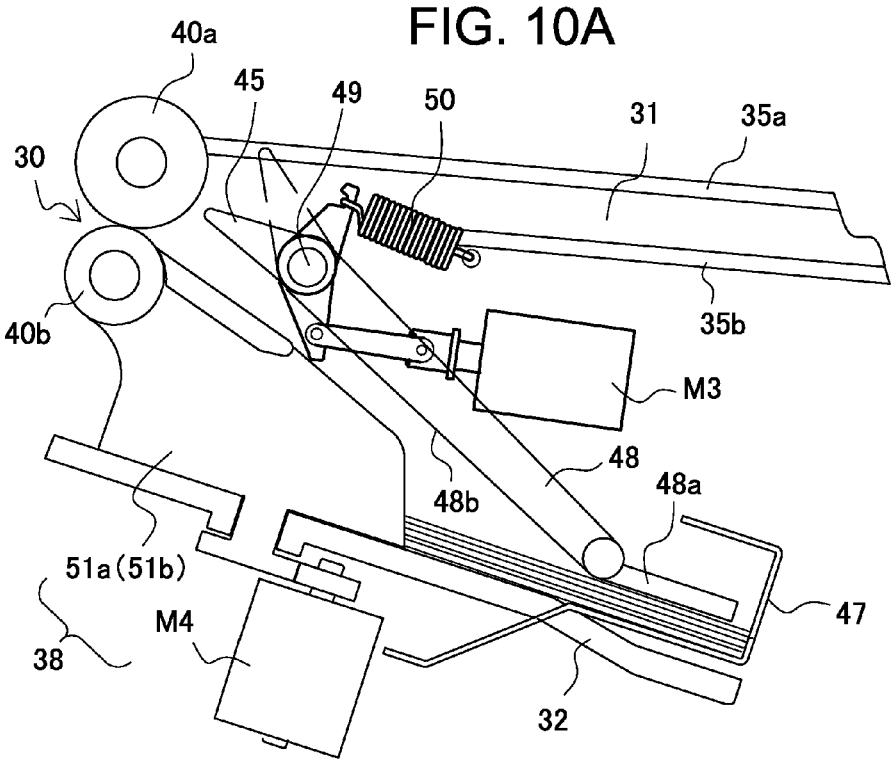
FIG. 10A shows a configuration explanatory view of sheet press means.

FIG. 10A shows the structure. The sheet press means 48 is comprised of swing lever structure such that the base end portion is supported on the frame to be swingable by the spindle 49, and in the front end portion is formed a paper press portion 48*a* in the shape of pressing a sheet. As shown in FIG. 10A, the sheet press means 48 provides the sheet with a pressing force by a biasing spring 50, and is configured to reduce the pressing force by the actuation means (actuator such as a solenoid and motor) M3.

In addition, the sheet press means 48 is provided with a carry-in guide 48*b* that guides the sheet fed from the back transport path 44 to the rear end regulation means 47. The carry-in guide 48*b* is to reliably guide a sheet with the front end curled or thin sheet (weak sheet) to the rear end regulation means 47. Further, as the form for releasing the pressing force of the paper press portion 48*a* with the actuation means M3, it is possible to adopt either of a form for retracting the paper press portion 48*a* to a position separated upward from the uppermost sheet on the processing tray, and a form for reducing the pressing force while contacting the uppermost sheet on the processing tray to the extent of not interfering with traveling of the sheet to carry in. As the specific structure, for example, it is possible to adjust the actuation stroke of the actuation means M3.

The sheet press means 48 and the path switch means 45 may be configured to perform open/close motion or pressing motion by individual actuation means, but in the means shown in the figure, it is configured that both means are interlocked by the common actuation means M3. As shown in FIG. 10A, in a state in which the paper press portion 48*a* of the sheet press means 48 presses the sheet, the path switch means 45 is interlocked to the dashed-line state shown in the figure so as to guide the sheet carried out to the sheet discharge outlet 30 to the back transport path 44 starting with the rear end side. Further, in a non-actuation state in which the paper press portion 48*a* releases the pressing force, the path switch means 45 is interlocked to the dashed-line state in the figure so as to guide the sheet from the sheet discharge path 31 in the direction of the sheet discharge outlet. For example, by providing a wind spring in the spindle 49, the interlocking mechanism is configured so that the path switch means 45 is interlocked to the solid-line position by rotation of one direction, and shifts to the dashed-line position under its own weight in rotation of the other direction.

<Loaded Sheet Alignment Means>

Further, the processing tray 32 is provided with the loaded sheet alignment means 38 for matching the width direction of loaded sheets with the reference position. The reference position is beforehand set as a center reference or side reference. The loaded sheet alignment means 38 shown in the figure is comprised of a pair of right and left alignment members (alignment plates) 51*a*, 51*b* disposed on the processing tray, and an alignment motor (shift motor) M4 that shifts the alignment members to positions in the sheet width direction. The detailed configuration of the loaded sheet alignment means 38 will be described later.

[Single-Sheet Alignment Mechanism]

In the sheet discharge path 31 is disposed a single-sheet alignment means 52 for aligning the posture in the width direction of the sheet with a reference line (center line in the apparatus shown in the figure) in feeding the sheet fed from the carry-in entrance 34 to the sheet discharge outlet 30. This is because of matching the position in the width direction (transport orthogonal direction) of the sheet with a beforehand set reference line in the process during which the sheet is transported from the carry-in entrance 34 to the sheet discharge outlet 30 in the sheet discharge path 31. Further, the single-sheet alignment means 52 is disposed above the processing tray 32 or above the post-processing means 39.

In addition, in the present invention, the "single-sheet alignment means" is the means for aligning the posture of the sheet that is transported on a sheet-by-sheet basis (in the path), and "bunch sheet alignment means" is the means for aligning the posture of bunch-shaped sheets (collected on the processing tray). Further, in either case, "alignment" means aligning the sheet with the beforehand set reference position, and the alignment position is set for either the center reference that the sheet center is the reference among sheets of different sizes or the side reference that the end edge of one side of the sheet is the reference. In the following description, for convenience in description, the center reference will be described, but the side reference is also allowed.

The single-sheet alignment means 52 is comprised of a pair of right and left side edge alignment members 53*a*, 53*b* that engage in the sheet side edges, and an alignment drive means 54 for shifting each side edge alignment member in the sheet width direction. Each of the side edge alignment members 53*a*, 53*b* is provided with an alignment surface 53*x* that engages in the side edge of the sheet, and is fit-supported by the apparatus frame (path guide member 35 in the apparatus shown in the figure) to be slidable.

Figure 6A:
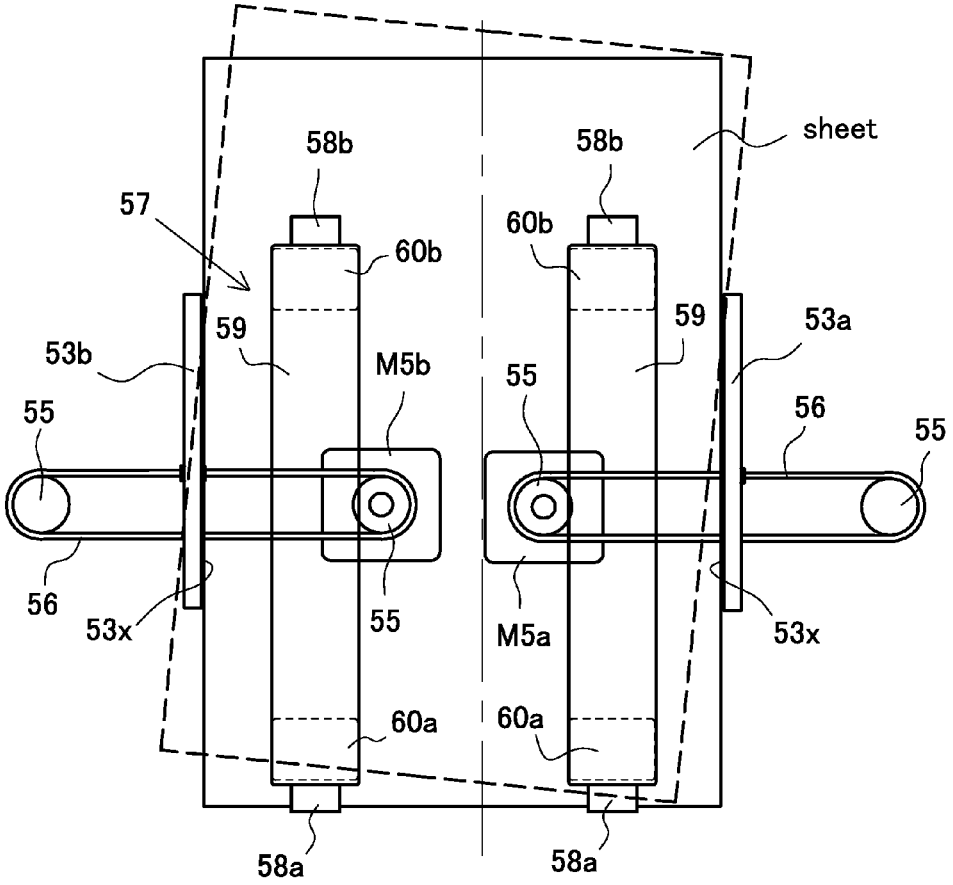
FIGS. 6A and 6B contain explanatory views illustrating a configuration of a skew correction means and side edge alignment means of the sheet discharge mechanism section of FIG. 2, where
Figure 6B:
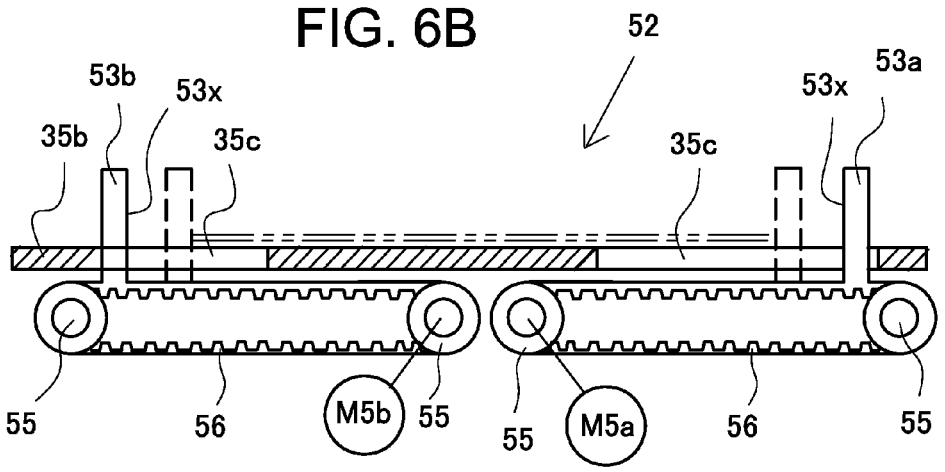

As shown in FIG. 6B, in the path guide (lower guide member) 35*b* are formed slits 35*c* in the direction orthogonal to the transport direction of the sheet, and the side edge alignment members 53 are fitted into the slits. The side edge alignment members 53 are provided with alignment surfaces 53*x* that engage in the sheet side edges. The pair of right and left side edge alignment members 53*a*, 53*b* are supported by the slits 35*c*, and are fixed to endless-shaped belts with gears (timing belts) 56 each fitted into a pair of pulleys disposed on the back side of the lower guide members 35*b*. One of the pulleys is coupled to a shift motor M5*a* (M5*b*).

Accordingly, by forward and backward rotation of the shift motor M5*a* (M5*b*), the side edge alignment members 53*a*, 53*b* approach or separate from the sheet center. Further, the pair of right and left side edge alignment members 53*a*, 53*b* are disposed in between the transport roller 36 and the sheet discharge roller 40 described previously. In addition, as shown the figure, the form is shown in which the pair of right and left side edge alignment members 53*a*, 53*b* are driven to approach or separate with reference to the sheet center with respective right and left shift motors M5*a*, M5*b*. Moreover, it is also possible to configure so that a rack provided in each of the right and left side edge alignment members 53 is coupled to a pinion provided in the apparatus frame to transfer rotation of the shift motor to the pinion. In this case, by rotation of the pinion, the right and left side edge alignment members 53*a*, 53*b* shift in mutually opposite directions by the same amount.

[Skew Correction Means]

The sheet discharge path 31 described previously is provided with a skew correction means 57 described below together with the single-sheet alignment means 52. Then, concurrently with the single-sheet alignment means 52 matching the sheet width direction with the reference line, the skew of the sheet is corrected. The skew correction means 57 matches the transport-direction front end edge or rear end edge of the sheet with the line (right-angle line) orthogonal to the transport direction.

The skew correction means 57 shown in the figure is comprised of pairs of engagement hooks 58*a*, 58*b* having a distance in the sheet width direction, and transport belts (belts with gears) 59 formed integrally with the engagement hooks, and the transport belts 59 provided with the engagement hooks 58 are disposed in between the transport roller 36 and the sheet discharge roller 40 described previously. Then, the sheet rear end (separated from the nip point) fed from the transport roller 36 engages in the pairs of engagement hooks 58*a*, 58*b*, is pressed by the engagement hooks 58 by the shift in the sheet discharge direction of the transport belts 59, and shifts in the direction of the sheet discharge outlet.

As shown in FIGS. 4 and 6A, the transport belt 59 is integrally provided with the pair of engagement hooks 58*a*, 58*b* having a distance L5 in the width direction of the sheet fed in the direction of the sheet discharge outlet in the sheet discharge path 31. Then, the transport belt 59 is fitted into a pair of pulleys 60*a*, 60*b* with gears, and turns and rotates in the sheet discharge direction by a transport motor M6 (not shown) coupled to one of the pulleys. The sheet is pushed out in the sheet discharge direction in two points (that may be three points or more) by the shift in the sheet discharge direction of the engagement hooks 58 disposed on the downstream side of the transport roller 36. At this point, as shown by dashed lines in FIG. 6A, even when the sheet is skewed, the skew is corrected in feeding the sheet to the sheet discharge outlet 30.

[Stack Tray]

Figure 11:
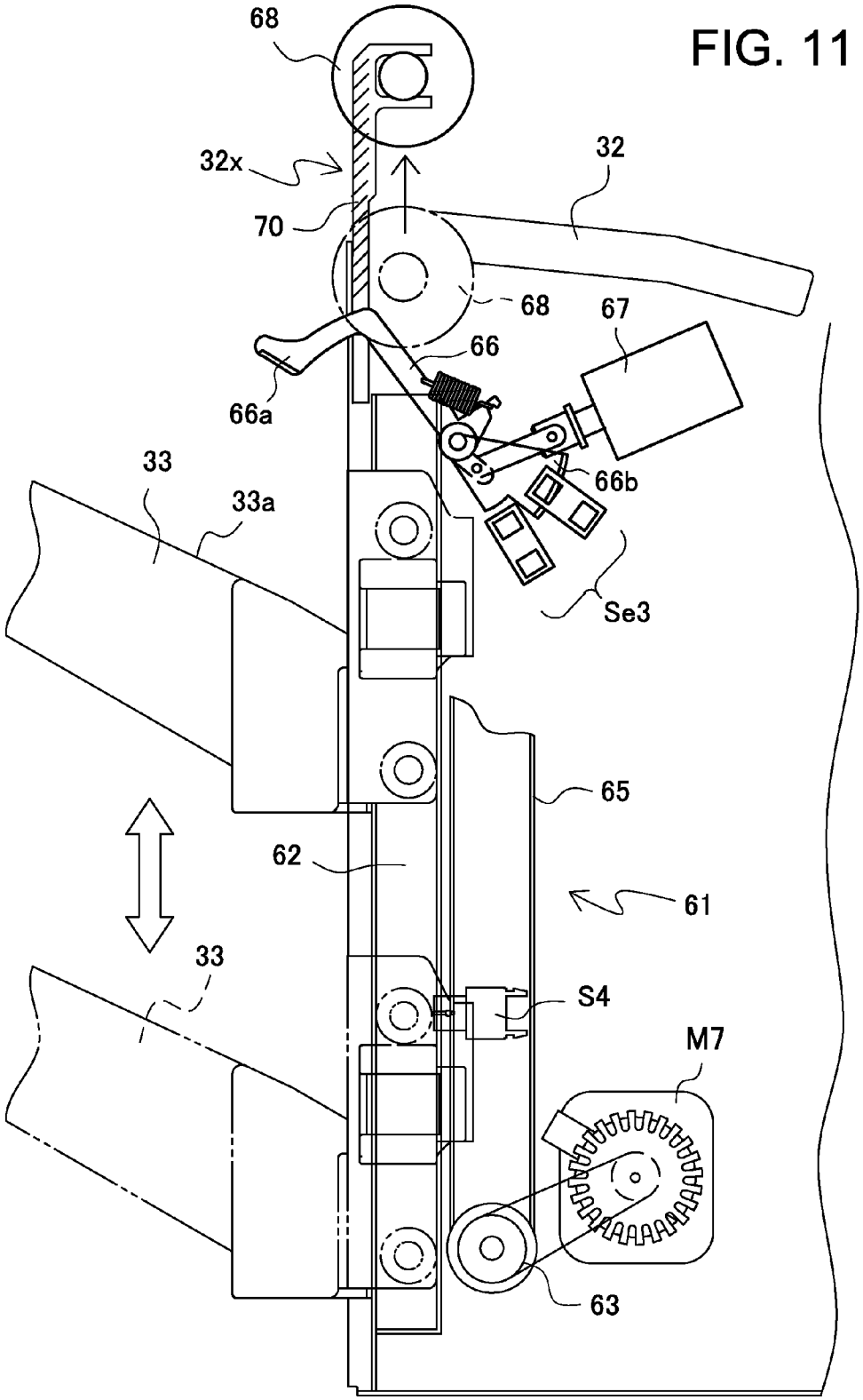
FIG. 11 is an explanatory view illustrating an up-and-down mechanism of the stack tray.

A configuration of the stack tray 33 will be described next. As shown in FIG. 11, the stack tray 33 is disposed on the downstream side of the processing tray 32. The stack tray 33 is comprised of a paper mount 33*a* on which sheets are placed, a tray up-and-down means 61 for moving the paper mount up and down corresponding to a load amount, a level sensor Se3 that detects sheets on the stack tray, and a lower limit sensor Se4 that detects the lower limit position of the tray.

The stack tray 33 is supported by a guide rail 62 disposed in the apparatus frame of the image formation unit A, and is configured to be able to move up and down in the vertical direction. A wind pulley 63 and support pulley are disposed at the upper and lower ends of the guide rail 62, and a wire 65 is looped between both pulleys. The wind pulley 63 is coupled to a lift motor M7, and the paper mount 33*a* is fixed to the wire 65.

In such a configuration, when the lift motor M7 rotates forward and backward, the wind pulley 63 rotates forward and backward, and the wire 65 wound around the pulleys shifts the paper mount (tray) 33*a* up or down in the upward direction or the downward direction. Further, in the level sensor Se3, a paper contact piece 66*a* and sensor flag 66*b* are attached to a swing arm member 66 that turns and rotates from the apparatus frame, not shown, to above the stack tray.

The swing arm member 66 is provided with an actuator 67 such as an actuation solenoid and motor to turn and rotate from a waiting position outside the tray to a detection position above the tray at timing at which the sheet is carried out to the stack tray 33. In a state in which the paper contact piece 66*a* at the front end contacts the uppermost sheet, the sensor flag 66*b* at the base end portion of the arm member is detected.

Then, a control means 83 described later is provided with a determination means for determining whether there is the need of causing the stack tray 33 to perform upward operation or the need of causing the tray 33 to perform downward operation using a detection signal from the level sensor Se3. By the determination means, the control means 83 rotates the lift motor M7 forward and backward by a predetermined amount to control the height position of the paper mount to an appropriate position. Further, the lower limit sensor Se4 is comprised of a limit sensor that detects that the paper mount 33*a* reaches the lower limit position.

Described is a configuration for carrying a sheet from the processing tray 32 to the stack tray 33. As shown in FIG. 4, a carrying-out roller 68 is provided at an exist end of the processing tray 32. The carrying-out roller 68 does not interfere with collection in collecting sheets on the tray in a state of being incorporated into the inside of the tray, while providing the sheet bunch with a transport force in carrying the collected sheets from the processing tray 32 to the downstream side.

The carrying-out roller 68 shown in the figure is disposed at the exit end of the processing tray 32 in the state of being incorporated into the inside of the tray, and is attached to a front end of an up-and-down arm 69 axially supported swingably by the apparatus frame. Then, a transport motor (not shown) for providing the carrying-out roller 68 with rotation is coupled, and the up-and-down arm 69 is coupled to an actuator (not shown) to move up and down between an upward position and a downward position.

Then, when the up-and-down arm 69 is in the downward position, the transport roller 68 is incorporated into the inside of the processing tray. Meanwhile, when the arm 69 is in the upward position, the transport roller 68 moves up and down to the position for coming into press-contact with the sheet discharge second roller 40*b* constituting the sheet discharge roller described previously. In other words, in the carrying-out roller 68, sheets are loaded above the roller in the state of being incorporated into the inside of the processing tray, and in carrying out the loaded sheets, the roller 68 pushes up the sheets to nip with the sheet discharge second roller 40*b*. Then, by rotating the carrying-out roller 68 in the sheet discharge direction, the sheet bunch is configured to be carried from the processing tray 32 to the stack tray 33.

Further, when the carrying-out roller 68 moves up and down between a downward retracted position (dashed lines in FIG. 11) and an upward carrying-out position (solid lines in FIG. 11), in conjunction therewith, a shutter plate 70, which shields an opening portion 32*x* of the processing tray 32, is moved up and down. Because the stack tray 33 has a "post-processing sheet discharge mode" to store sheets (bunch) which are subjected to post-processing and carried out of the processing tray 32 and a "straight sheet discharge mode" to store a sheet that is directly carried out of the sheet discharge path 31, the reason is to shield the opening portion 32*x* of the processing tray in the straight sheet discharge mode.

In straight sheet discharge for carrying out the sheet from the sheet discharge rollers 40 directly to the processing tray 32 without transporting the sheet backward, the sheet is nipped with the sheet discharge rollers (sheet discharge first and second rollers) 40 and is carried out from the sheet discharge path 31. At this point, the sheet discharge rollers 40 are rotated only in the sheet discharge direction without rotating backward. Then, the sheet rear end drops on the stack tray 33 from the sheet discharge roller 40, and since there is space between the processing tray 32 and the sheet discharge rollers 40, there is the risk that sheets loaded on the stack tray roll into the processing tray side.

Then, the board-wall-shaped shutter plate 70 shields the exit end (opening portion) 32*x* of the processing tray 32. In the apparatus as shown in the figure, it is configured that the shutter plate 70 moves up and down in conjunction with the up-and-down arm 69 that moves up and down the carrying-out roller 68.

[Loaded Sheet Alignment Means]

In the processing tray 32 is disposed the loaded sheet alignment means 38 for aligning the width-direction position of loaded sheets with the reference line. As in the single-sheet alignment means 52 described previously, the loaded sheet alignment means 38 matches the width-direction position (sheet-discharge orthogonal direction) of a sheet of a different size with the beforehand set reference line. Therefore, the processing tray 32 is provided with slit grooves 32*a* in the direction orthogonal to the sheet discharge direction, and a pair of right and left side edge alignment members 51*a*, 51*b* are fitted slidably into the slit grooves 32*a*.

Then, a pair of right and left side edge alignment members 51*a*, 51*b* are configured so that the right and left members approach or separate from by the same amount with reference to the beforehand set center line, or that one of the right and left members is fixed, while the other one approaches or separates with reference to the side line set at one end edge.

Figure 3:
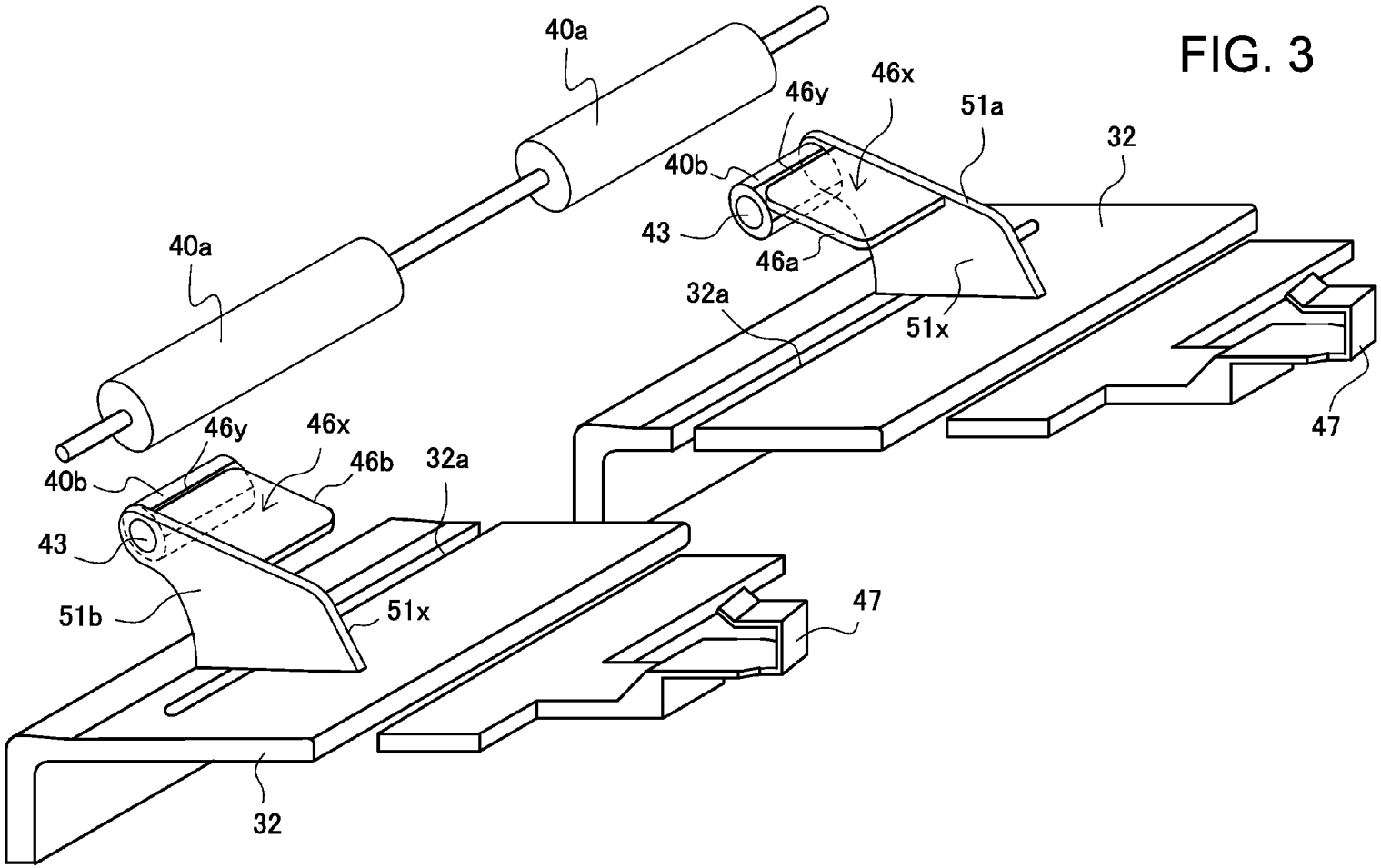
FIG. 3 is a perspective view illustrating the relationship among a divider guide, sheet discharge roller and side edge alignment member that are a sheet discharge mechanism section of the post-processing apparatus of FIG. 2.

As shown in FIG. 3, the processing tray 32 is provided with slit grooves 32*a* (hereinafter, referred to as "tray grooves") in the direction orthogonal to the sheet discharge direction, and a pair of right and left side edge alignment members 51*a*, 51*b* are fitted slidably into the tray grooves 32*a*. Each of the side edge alignment members 51*a*, 51*b* is provided with an alignment surface 51*x* that engages in the side edges of sheets loaded on the processing tray, and when the right and left alignment surfaces 52*x* concurrently shift in the direction of approaching, the sheets loaded on the processing tray are width-shifted and aligned.

Therefore, an alignment motor M4 is coupled to each of the side edge alignment members 51*a*, 51*b*, and it is configured that a pinion 64 coupled to the motor and a rack 51*r* formed in the alignment member mutually engage. Then, by forward and backward rotation of the alignment motor M4, the right and left side edge alignment members 51*a*, 51*b* mutually approach or separate, and are configured to width-shift sheets to match with the reference line when approaching.

[Interlocking Relationship Between the Divider Guide and Loaded Sheet Alignment Means]

In the above-mentioned configuration, the path guide 35 forming the sheet discharge path 31, the divider guide members 46 provided in back transport path 44 and the processing tray 32 are disposed in this order vertically. The is because of reversing the sheet discharge direction of the sheet that is carried out of the sheet discharge path 31 to store in the processing tray 32 and thereby making the sheet-discharge direction dimension of the apparatus small.

Therefore, the apparatus shown in the figure is characterized by shifting the divider guide members 46 disposed upward and the loaded sheet alignment means 38 disposed downward in the sheet width direction by the mutually common drive means, and shortening the actuation strokes of the guides and means. The configuration will be described below.

Figure 5A:
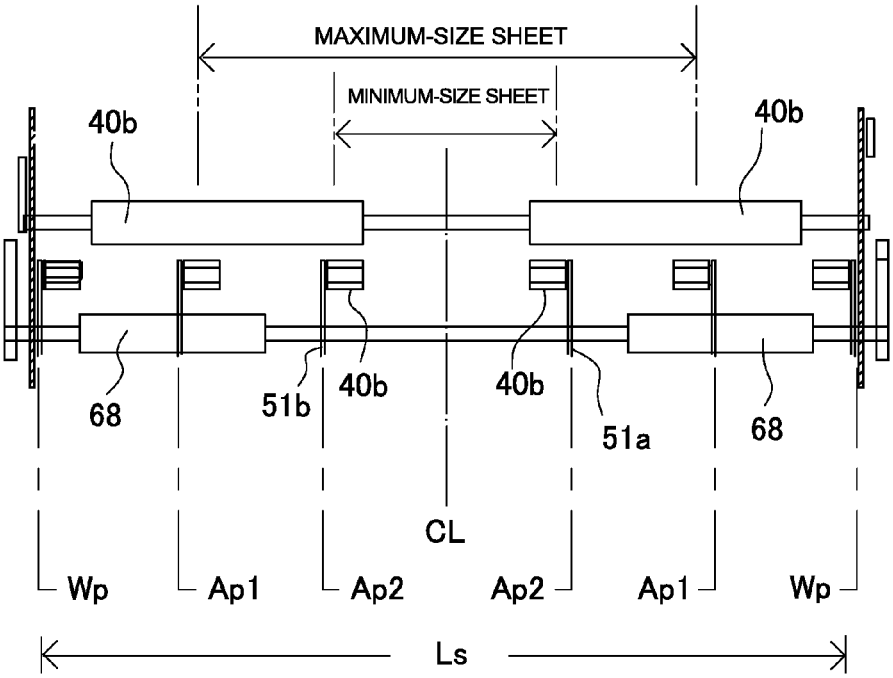
FIG. 5A is an explanatory view illustrating the relationship (sheet discharge mechanism) among the divider guide, sheet discharge roller and side edge alignment member of FIG. 3.
Figure 5B:
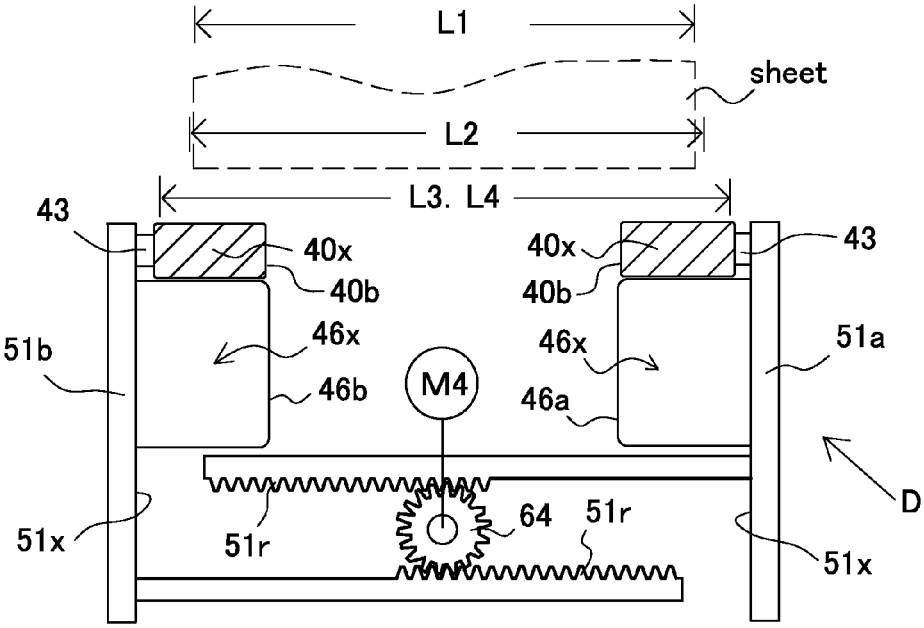
FIG. 5B is an explanatory view of a different face of the sheet discharge mechanism.

First, as shown in FIG. 5B, for the divider guide members 46 and sheet discharge second rollers (sheet discharge rollers) 40*b* contacting the sheet underside, right and left pairs thereof are formed in the sheet width direction. This is because of simplifying the mechanism for retracting the right and left guides and rollers to positions separated from the sheet side edges. Then, each of the right and left divider guide members 46*a*, 46*b* is provided with a guide surface 46*x* that contacts the sheet underside to guide onto the processing tray, and a roller holder portion 46*y* that rotatably supports the sheet discharge second roller 40*b*.

Meanwhile, for the side edge alignment members 51 disposed in the processing tray 32, as described previously, a pair of right and left members are provided in the sheet width direction, and are supported by the processing tray 32 (or may be supported by the apparatus frame other than the tray) to be able to shift.

Then, the right and left side edge alignment members 51*a*, 51*b* and the divider guide members 46 are integrated, for example, by mold forming of synthetic resin. Then, the guide surface 46*x* and roller holder portion 46*y* are formed in each of the divider guides 46. Further, the alignment surface 51*x* that engages in the side edge is provided in the side edge alignment member 51. Then, for the side edge alignment members 51 and divider guide members 46 disposed opposite to the right and left, right members and left members are respectively integrated.

By this means, the guide surfaces 46*x*, sheet discharge second rollers 40*b* and alignment surfaces 51*x* are opposite to the right and left in an integrated state. The alignment motor M4 is coupled thus configured side edge alignment members 51 and divider guide members 46. By forward and backward rotation of the motor, the members shift in the sheet width direction in an integral manner.

By such a configuration, the sheet discharge roller 40 which transports the sheet from the sheet discharge outlet 30 onto the processing tray, and the guide surface 46*x* which guides the sheet onto the tray are configured as a unit so as to width-shift and align the sheets loaded on the processing tray to match with the reference line, and for example, as shown in the figure, are attached to the processing tray 32 to be able shift in the sheet direction. FIG. 5B shows a width size L1 of a sheet that is carried in the processing tray 32 at this point, a distance L2 (referred to as an alignment surface distance) between the alignment surfaces, a sheet support distance L3 (referred to as a guide surface distance) between the right and left guide surfaces 46*x*, and a sheet engagement distance L4 (referred to as a roller distance) between the right and left sheet discharge rollers 40*b*.

In FIGS. 5A and 5B, right and left width-shift units D (units obtained by integrating the divider guide members 46 and side edge alignment members 51; the same in the following description) reciprocate with a predetermined stroke Ls. The stroke will be described below. In waiting positions Wp of the width-shift units D, the distance L2 between the right and left alignment surfaces is set to be longer (wider) than the width length of the maximum side sheet. This is because of causing the width-shift units D to wait in positions separated from the maximum size width of sheets collected on the processing tray, and by this means, the positions are set at regions that do not interfere with a sheet even when the sheet proceeds onto the tray with a disordered posture. The waiting positions Wp are set at home positions when the apparatus is initialized.

Actuation positions Ap of the width-shift units D are set at positions to engage in the side edges of the sheet. The positions are set at ½ positions of the sheet size with reference to the beforehand set sheet center (CL shown in the figure). Accordingly, even when the sheet that is carried in the processing tray 32 is fed while leaning, or fed while being skewed and inclined, the sheet is set in the correct position on the processing tray by shifts of the width-shift units D from the waiting positions Wp to the actuation positions Ap.

Further, the alignment surface distance L2, guide surface distance L3 and roller surface distance L4 are configured so that the distances (lengths) are capable of being varied corresponding to the sheet size L1, and the width-shift units D are shifted to the distance corresponding to the width size of the sheet that is fed to the sheet discharge path 31. The unit shift is executed by the control means 83 described later. In this case, the roller surface distance L4 and the guide surface distance L3 are substantially the same widths, FIG. 5B shows the position relationship thereof, and outer positions for the rollers or guide surfaces to support (contact) the sheet are defined as the roller surface distance L4 or guide surface distance L3, respectively.

In addition, since the apparatus shown in the figure is provided with the single-sheet alignment means 52 for matching the width-direction posture of the sheet with the reference line in the sheet discharge path 31 as described previously, either the case of no need of aligning the width-direction position of the sheet on the processing tray or the case of width-shifting and aligning again sheets that are width-shifted and aligned during the transport process after collecting on the processing tray 32 can be set by the method being either "the usage method that does not require the degree of alignment of a sheet bunch in bookbinding processing" or "the usage method that requires the degree of alignment". The control means 83 described later is configured so that the operator is capable of selecting aligning the sheet width direction only in the sheet discharge path 31 or aligning the width direction both in the sheet discharge path 31 and on the processing tray.

The width-shift units D as described above are each obtained by integrally configuring the alignment surface 51*x*, guide surface 46*x* and sheet support surface 40*x* of the sheet discharge roller, and reciprocate between the waiting positions Wp and actuation positions Ap. The waiting positions Wp are set to outer sides of the maximum-size sheet, and the actuation positions Ap are set at positions for the alignment surfaces 53*x* to width-shift and align the sheet side edges corresponding to the sheet size. Moreover, it is possible to configure the width-shift units as in FIG. 10A.

The width-shift units D are characterized by curving the sheet that is guided from the sheet discharge outlet 30 to the processing tray 32 to carry in while providing the strength. In the Embodiment as described previously, the alignment surface distance L2, guide surface distance L3 and sheet support surface distance L4 are set at almost same length dimensions. Then, the alignment surface distance L2 is the length matching with the sheet size L1, and the guide surface distance L3 and the sheet support surface distance L4 are set at sizes slightly longer than the sheet size L1.

[Different Embodiment of the Width-Shift Unit]

Figure 10B:
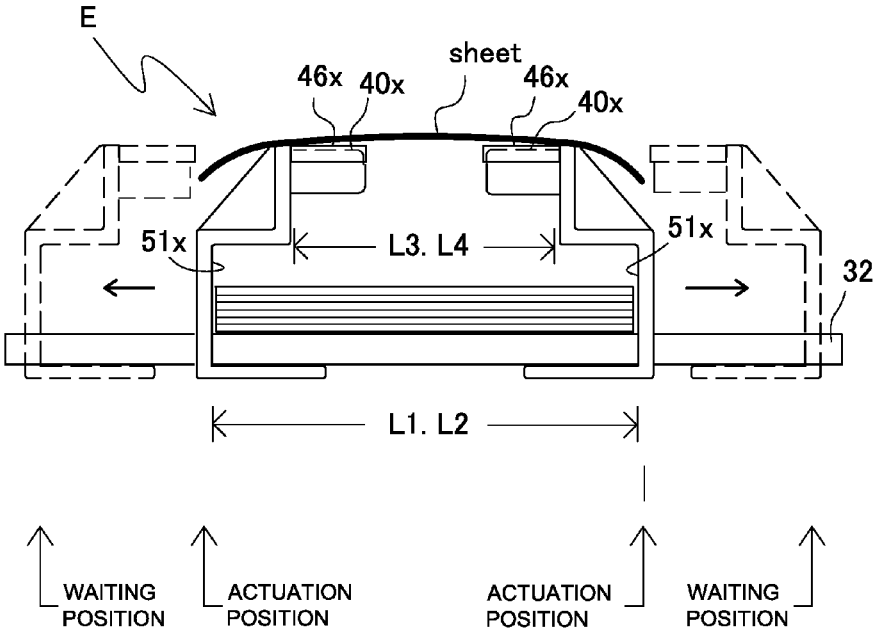
FIG. 10B shows a loaded sheet alignment means in the processing tray of an Embodiment different from FIG. 3, while showing an aspect in which the alignment surface and the guide surface of the guide are disposed in different positions in the sheet width direction.

A configuration of width-shift units E as shown in FIG. 10B will be described. The width-shift units E are formed as a pair of right and left units, and each of right and left of alignment surfaces 51*x*, guide surfaces 46*x* and sheet support surfaces 40*x* is integrally formed. Then, the distance L2 between the right and left alignment surfaces is set at the substantially same length as the sheet size L1. Then, the units as shown in the figure are characterized by setting the guide surface distance L3 and sheet support surface distance L4 to be shorter than the sheet size L1, curving the opposite end portions of the sheet to sag downward and carrying in the processing tray 32 from the sheet discharge outlet 30.

In thus guiding a sheet to the processing tray 32 along the guide surface 46*x*, when the sheet is carried in while curving the opposite end portions of the sheet, the sheet enters onto the uppermost sheet on the processing tray due to the strength thereof, and strikes the rear end regulation means 47 along the surface. By this means, problems such as front end folding of the sheet and skew curving do not occur.

[Control Configuration]

Figure 12:
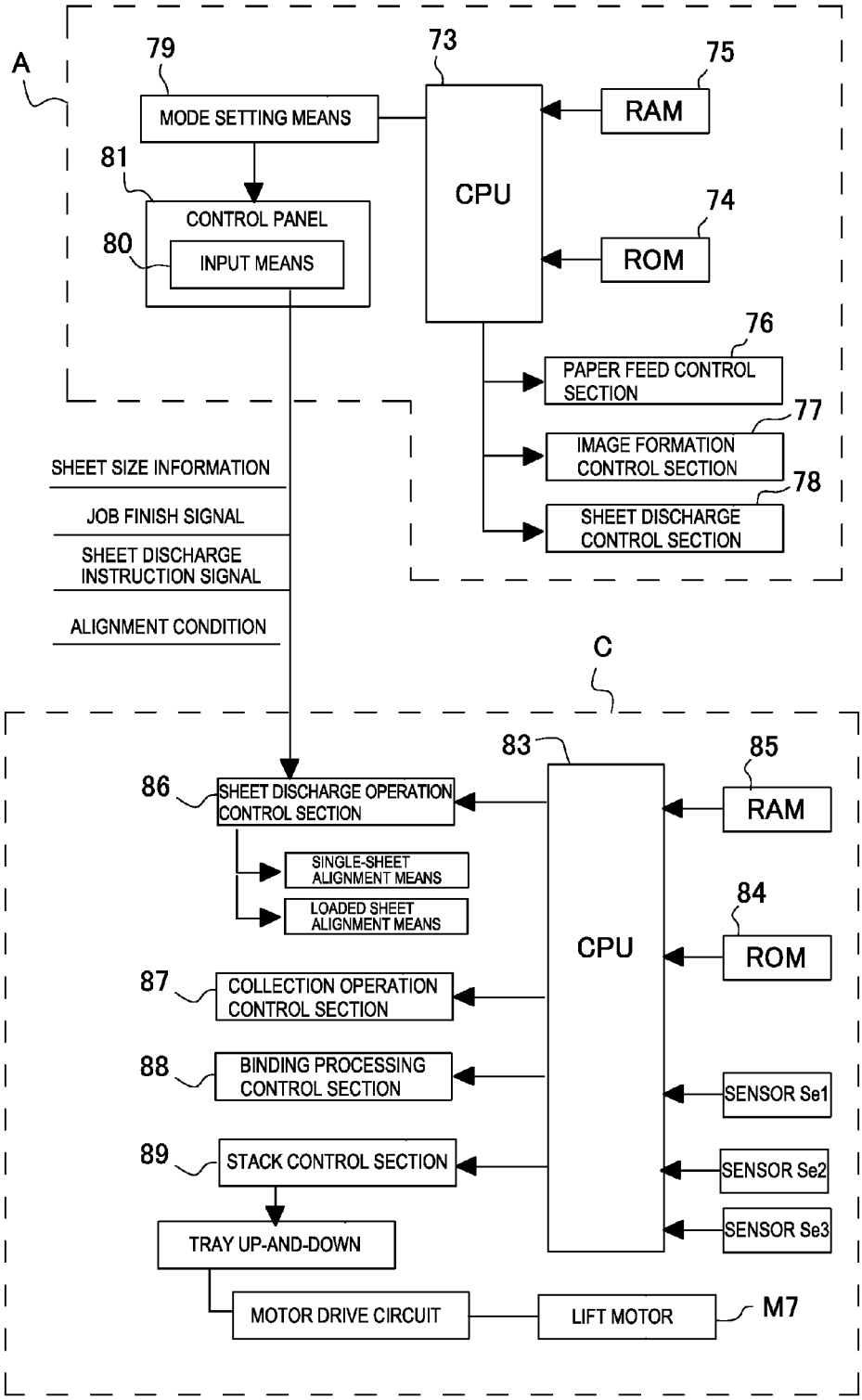
FIG. 12 is a block diagram illustrating a control configuration in the system of FIG. 1.

A control configuration of the image formation system as shown in FIG. 1 will be described according to FIG. 12. The image formation unit A is provided with a control CPU 73, and the control CPU 73 is connected to ROM 74 for storing operation programs, and RAM 75 for storing control data. Then, the control CPU 73 is provided with a paper feed control section 76, image formation control section 77, and sheet discharge control section 78. Concurrently therewith, the control CPU 73 is connected to a mode setting means 79 and a control panel 81 provided with an input means 80.

Further, the control CPU 73 is configured to select a "printout mode", "jog mode" and "post-processing mode". In the "printout mode", image-formed sheets are stored in the stack tray 33 without performing any finish processing. In the "jog mode", image-formed sheets are offset-stored in the stack tray 33 to be able to collate and divide. Further, in the "post-processing mode", image-formed sheets are collated and collected, and stored in the stack tray 33 after performing binding processing.

The post-processing unit C is provided with a post-processing control CPU 83, and the CPU 83 is connected to ROM 84 for storing operation programs, and RAM 85 for storing control data. Then, the control section of the image formation unit A transfers, to the post-processing control CPU 83, sheet size information, sheet discharge instruction signal, and mode setting commands for the post-processing mode and the printout mode.

The post-processing control CPU 83 is provided with a sheet discharge operation control section 86, a collection operation control section 87 that collates and collects sheets on the processing tray 32, a binding processing control section 88, and a stack control section 89.

[Operation Explanation]

The control CPU 73 of the image formation unit A executes the following image formation operation according to the image formation program stored in the ROM 74. Similarly, the control CPU 83 of the post-processing unit C executes the following post-processing operation according to the post-processing program stored in the ROM 84.

[Image Formation Operation]

When a "one-side printing mode" is selected, the control CPU 73 feeds out a sheet of the set size from the paper feed cassette 5 to feed to the register roller pair 8. Around the time of feeding, the control CPU 73 forms an image on the transfer belt 12 according to predetermined image data. The image data is stored in a data storage section, not shown, or is transferred from an outside apparatus coupled to the image formation unit A.

Then, the control CPU 73 transfers the toner image formed on the transfer belt 12 to the sheet, which is fed from the register roller pair 8, in the image formation section 2, and fuses the image in the fuser 14 on the downstream side. Subsequently, the control CPU 73 feeds the sheet with the image formed to the sheet discharge path 17 to transfer to the post-processing unit C, described later.

Further, when a "two-side printing mode" is selected, the control CPU 73 executes the above-mentioned operation to form an image on the frontside of the sheet, then reverses the side of the sheet in the duplex path 18 connected to the sheet discharge section 3 to feed again to the image formation section 2, forms an image on the backside of the sheet, and then, feeds the sheet to the sheet discharge path 17. At this point, the control CPU 73 causes the post-processing unit C to execute the following operation. The control CPU 83 of the post-processing unit C feeds the sheet, which is fed to the sheet discharge path 31 with a detection signal of the sensor such that the sheet front end arrives at the sheet discharge path 31, from the sheet discharge path to the back transport path 44.

Concurrently with the path switching control, when the sheet front end is carried in the processing tray 32 from the back transport path 44, the control CPU 83 shifts the sheet discharge first rollers 40*a* from the waiting positions to the actuation positions, and at the same time, rotates the rollers. Then, the sheet carried in the processing tray 32 is fed to the downstream side along the processing tray 32 by rotation of the sheet discharge first rollers 40*a*.

The control means (post-processing control CPU) 83 executes the following sheet discharge operation, according to the programs stored in the ROM 74 of the image formation unit A and the ROM 84 of the post-processing unit. The control means 83 shown in the figure is provided with a "straight sheet discharge mode (printout sheet discharge mode)", "jog sheet discharge mode" and"post-processing sheet discharge mode".

In the "straight sheet discharge mode", the sheet fed to the carry-in entrance 34 is carried out from the sheet discharge path 31 to the stack tray 33 and stored. In the apparatus shown in the figure, the sheet fed through the sheet discharge path 31 by the sheet discharge rollers 40 is directly dropped on the stack tray 33 by the sheet discharge rollers 40 (without guiding to the back transport path) and stored. Therefore, the carrying-out roller 68 is shifted to the state in press-contact with the sheet discharge second rollers 40*b* by the up-and-down arm 69, and the shutter plate 70 shields the exist end space of the processing tray 32. In addition, at this point, the carrying-out roller 68 is coupled to a motor, for example, with a one-way clutch to be an idle state.

The transport roller 68 and sheet discharge rollers 40 are rotated in the sheet discharge direction in such a state to carry out the sheet from the sheet discharge outlet 30 to the outside. Then, the sheet drops onto the stack tray, the opening portion 32*x* at the exit end of the processing tray 32 is covered with the shutter plate 70, and the sheet is loaded and stored on the uppermost sheet.

In the "jog mode", the sheet fed to the carry-in entrance 34 is stored in the stack tray 33 from the sheet discharge path 31 while being divided and collated. In execution of this mode, with the sheet discharge first rollers 40*a* waiting in the separate positions, the single-sheet alignment means 52 is actuated at timing at which the sheet rear end fed to the sheet discharge path 31 is released from the transport roller. At this point, the sheet is supported by the path guide 35 of the sheet discharge path 31 in a free state without being nipped by rollers.

Then, a pair of right and left side edge alignment members 53*a*, 53*b* perform width-shift alignment. The width-shift position at this point is set at a beforehand determined off set position for each collation of sheets. Further, in execution of this mode, the carrying-out roller 68 is held in the upward position while being brought into press-contact with the sheet discharge second rollers 40*b*, and the shutter plate 70 covers the tray opening portion 32*x*.

In the "post-processing sheet discharge mode", sheets fed to the carry-in entrance 34 are collected on the processing tray 32 from the sheet discharge path 31, undergo the binding processing, and are stored in the stack tray 33. The sheet discharge operation in this mode will be described according to the figures. FIG. 7A shows a state in which the sheet is carried in the sheet discharge path 31, and FIG. 7B shows the case where the single-sheet alignment means 52 inside the path width-shifts and aligns the sheet in the transport orthogonal direction.

[Carry-In Operation]

In the carry-in initial state, the sheet is fed from the carry-in entrance 34 to the inside of the path, and after the position of the sheet front end is detected by the carry-in sensor Se1, is carried in toward the sheet discharge outlet 30 by the transport roller 36 (FIG. 7A).

[Width-Shift Alignment Operation]

The control means 83 as described previously determines carrying-out timing at which the sheet rear end is released from the transport roller 36 to the downstream thereof, with reference to the sheet size signal sent from the image formation unit A and the detection signal such that the carry-in sensor Se1 detects the sheet front end. Based on this determination, the control means 83 actuates the single-sheet alignment means 52. Actuation of the alignment means is to shift positions of the side edge alignment members 53 from the waiting positions to the alignment positions and match the sheet center with the beforehand set center line. Concurrently therewith, the control means 83 actuates the skew correction means 57. The skew collection means 57 is comprised of the transport belts 59 having the engagement hooks 58, and corrects skew of the sheet by control of the transport motor M6 coupled to the drive pulley 60 (see FIG. 7B).

The sheet is fed to the sheet discharge outlet 30 by such operation, while being corrected in the sheet width direction by the single-sheet alignment means 52, and at the same time, the front and back in the transport direction are corrected to the correct posture by the skew correction means 57. In a stage in which the sheet rear end passes through the branch portion 35*y* of the sheet discharge path 31, the control means 83 shifts positions of the sheet discharge first rollers 40*a* from the separate positions to the press-contact positions. Concurrently therewith, the means 83 actuates the path switch means 45 to form the path for guiding the sheet rear end to the processing tray side.

Then, the control means 83 rotates the sheet discharge rollers 40 backward in the opposite direction to the sheet discharge direction. Then, the sheet is guided to the back transport path 44 via the path switch means 45 starting with the rear end side. In the back transport path 44 are disposed one kind of sheet discharge rollers (sheet discharge second rollers; sheet discharge second rollers 40*b*) and divider guide members 46. By these rollers and guides, the sheet shifts in the back transport path 44 toward the processing tray 32. In addition, the sheet press portion 48*a* of the sheet press means 48 is held in a position floating from the sheet on the processing tray. Further, the carry-in guide 48*b* of the sheet press means 48 helps the sheet to be guided onto the processing tray from the sheet discharge path 31 along the divider guide members 46 (see FIG. 8C).

Figure 8C:
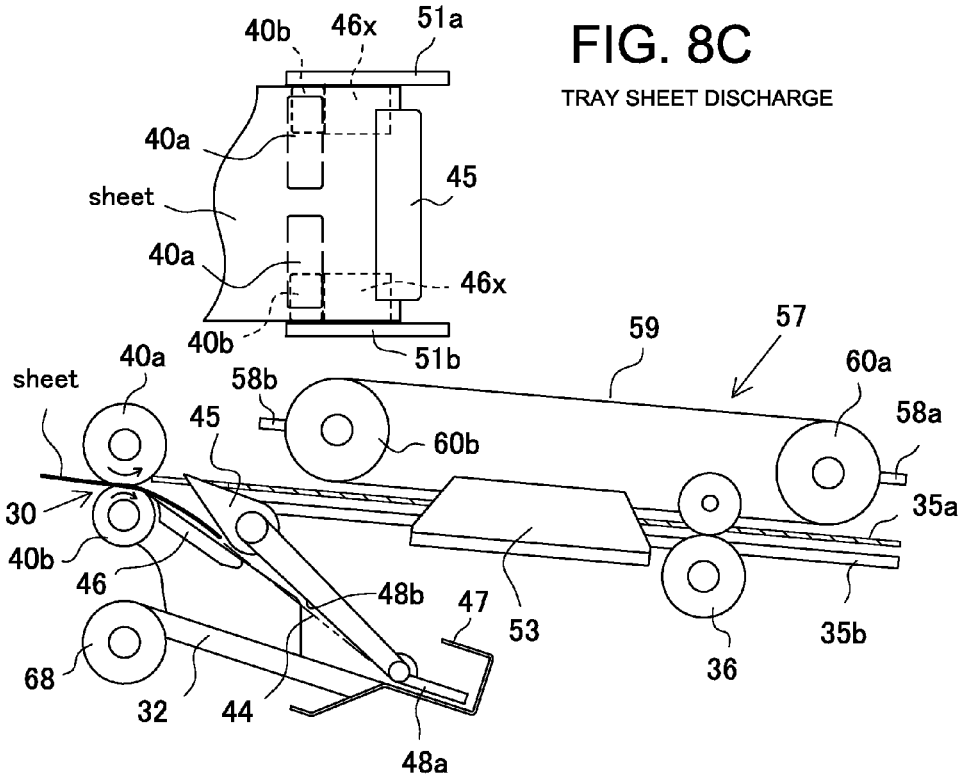
FIGS. 8C and 8D show operating states of the sheet discharge mechanism of FIG. 2, where
Figure 8D:
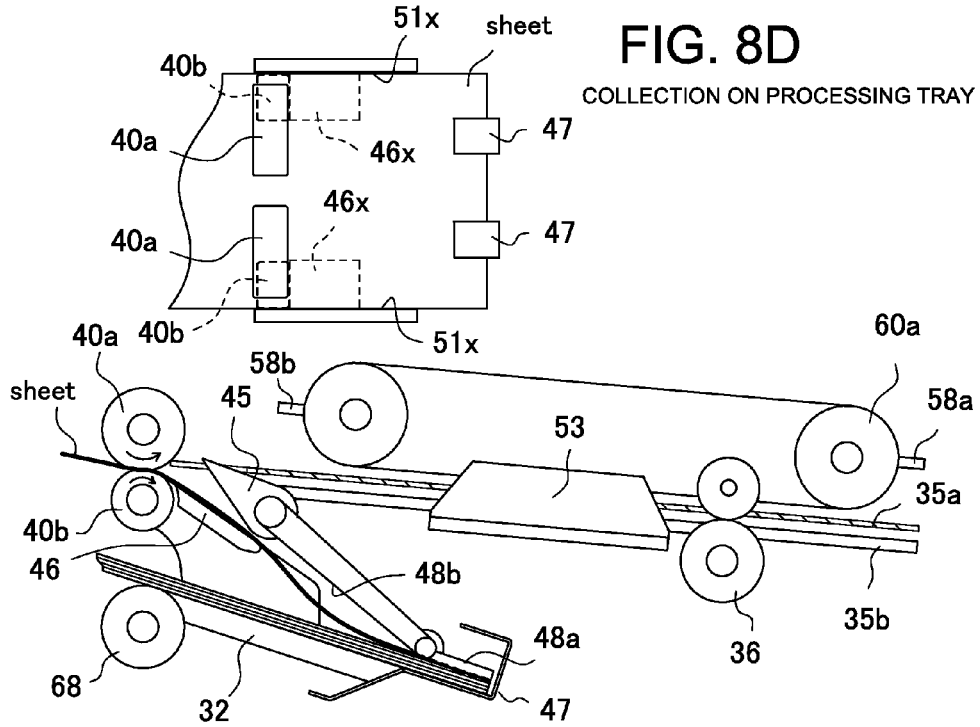

Next, FIG. 8D shows a state in which the sheet strikes the rear end regulation means 47 on the processing tray from the sheet discharge outlet 30 and is aligned, and FIG. 9E shows operation for retracting the divider guide members 46 and the sheet discharge rollers (sheet discharge second rollers) 40*b* engaging in the sheet rear end portion to the sheet lateral positions after striking and aligning the sheet rear end portion and dropping the sheet rear end portion onto the processing tray.

In FIG. 8D, the sheet is guided from the back transport path 44 to the rear end regulation means 47 on the processing tray, and the rear end edge is struck and aligned. At this point, in the sheet press means 48, the sheet press portion 48*a* is held in the state floating from the loaded sheets on the processing tray, and the carry-in guide portion 48*b* guides the sheet toward the rear end regulation means 47. At this point, the sheet underside is supported by the divider guide members 46 and sheet discharge second rollers 40*b*, and the opposite end edges of the sheet are regulated in the position by the alignment surfaces 51*x*.

In FIG. 9E, at predicted time the sheet rear end is struck against the rear end regulation means 47 (after a lapse of predetermined time with reference to a signal such that the sheet discharge sensor Se2 detects the sheet rear end), the control means 83 actuates the sheet press means 48 with an actuator, not shown, so that the paper press portion 48*a* presses the sheet rear end portion to hold on the processing tray. Subsequently, the means 83 shifts the divider guide members 46 and the sheet discharge second rollers 40*b* from the actuation positions Ap for engaging in the sheet to the waiting positions Wp.

In FIG. 9F, by executing the aforementioned operation repeatedly, predetermined sheets are collated and collected on the processing tray. Then, the control means 83 executes the post-processing operation (binding processing with the staple apparatus) using a job finish signal from the image formation unit A. Then, as shown in the figure, the means 83 carries out the sheets, which are collected on the processing tray and subjected to the post-processing, toward the stack tray 33.

Therefore, the control means 83 shifts the sheet discharge first rollers 40*a* of the sheet discharge rollers 40 (the sheet discharge first rollers and sheet discharge second rollers as described previously) to the waiting positions retraced upward, and at the same time, shifts the sheet discharge second rollers 40*b* from the retracted positions to the actuation positions for engaging in the sheet. Then, the means 83 moves the carrying-out roller 68 up to the position for coming into press-contact with the sheet discharge second rollers 40*b* to nip the sheet bunch with the sheet discharge second rollers 40*b*. After this operation, the control means 83 rotates the carrying-out roller 68 in the sheet discharge direction to carry the sheet bunch to the stack tray 33 on the downstream side.

[Sheet Discharge Operation]

Next, the control means 83 will be described according to the flowchart in FIG. 13. FIG. 13 is a conceptual diagram illustrating the post-processing operation of the image formation system of FIG. 1, and the control means 73 of the image formation unit A sets a finish processing mode concurrently with setting of image formation conditions. As setting of the finish processing mode, for example, an operator inputs whether or not to perform post-processing on image-formed sheets or whether or not to stack and store without performing post-processing from the control panel 81 or the like (St01).

The apparatus shown in the figure is to select the finish processing mode from among the "printout mode" "jog stack mode" and "post-processing mode". Then, the post-processing mode is set at a processing mode for collating and collecting sheets on the processing tray 32 to perform staple biding. Hereinafter, the post-processing mode means the bookbinding finish processing, and as the post-processing means, as well as the staple binding processing, stamp processing, punching processing and the like is known.

Hereinafter, according to the figures, in regard to the case of setting at the post-processing mode (St02), the operation will be described. The control means 83 of the post-processing unit C is configured to set whether or not to align the sheet width direction in the sheet discharge path 31 (St03) and set whether or not to execute the alignment operation in the sheet width direction in the processing tray 32 (St04). As the alignment operation, at least one is selected, but for example, when a priority is given to processing speed, it is possible to set a mode not to execute sheet alignment in the width direction.

Then, the operation for aligning the width in the sheet discharge path 31 (St03) is executed by the single-sheet alignment means 52 as described previously. Further, the operation for aligning the width on the processing tray 32 (St04) is executed by the loaded sheet alignment means 38 as described previously. When the width alignment operation in the sheet discharge path 31 and the width alignment operation on the processing tray 32 are selected in setting (St02) of the alignment condition, the sheets are positioned in a correct posture by the post-processing position on the processing tray. Further, when the width alignment operation is executed only in the sheet discharge path 31, slight fluctuations occur in sheets set in the processing position, but there is convenience in performing speedy post-processing.

When either alignment operation is selected, the control means 83 sets the positions of the alignment surfaces 53*x* of the side edge alignment members 53 for the actuation positions Ap and the waiting positions Wp, using the sheet size information sent from the image formation unit A and the beforehand set reference position (center line reference or side line reference). Then, using a timing signal such that the sheet is carried onto the processing tray (for example, after a lapse of predetermined time since the signal such that the sheet discharge sensor Se2 detects the sheet rear end), the control means 83 executes the width-shift operation.

Figure 14:
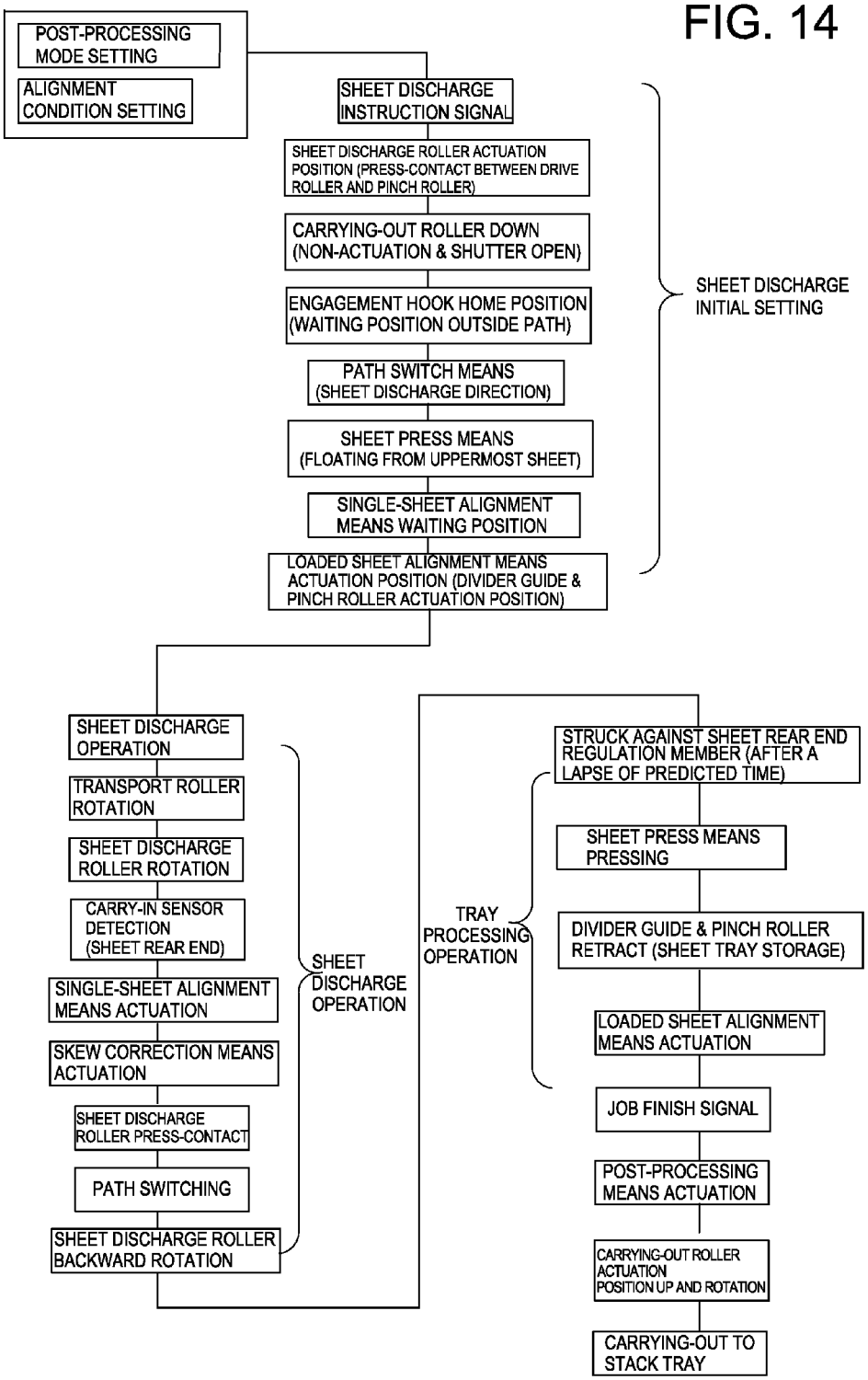
FIG. 14 is an explanatory view illustrating a specific operation flow of the control means in the control configuration of FIG. 12.
Figure 15:
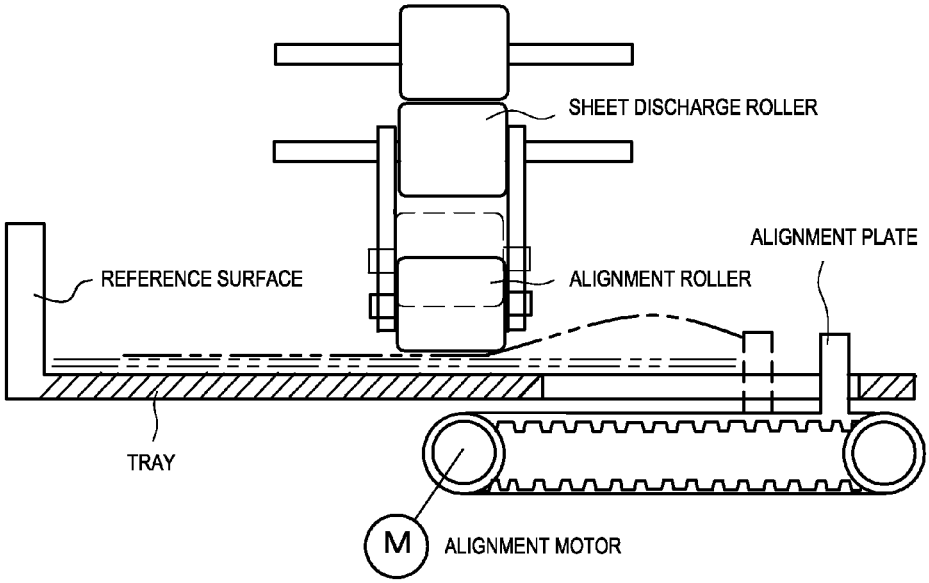
FIG. 15 is an explanatory view of a state in which a sheet is width-shifted and aligned in the processing tray in a conventional apparatus.

Next, specific operation of the control means 83 will be described according to the flowchart of FIG. 14. The control means 83 of the post-processing unit C performs setting of the post-processing mode and setting of the alignment condition with the control CPU 73 of the image formation unit A. When the control means 83 receives a sheet discharge instruction signal from the image formation unit A, the means 83 shifts the sheet discharge rollers 40 to the waiting positions (state in which the sheet discharge first rollers are separated from the sheet discharge second rollers) in the "post-processing" mode. Further, the control means 83 shifts the transport roller 68 to the non-actuation position (waiting state in which the roller is incorporated into the processing tray).

The control means 83 performs the following operation:

(1) The means 83 causes the engagement hooks 58 of the skew correction means 57 to wait in the home positions (waiting positions outside the sheet discharge path: state of FIG. 7A). Further, the means 83 positions the path switch means 45 in the sheet discharge direction (state of FIG. 7A).

(2) The means 83 positions the sheet press means 48 so that the paper press portion 48*a* is in a press release state floating from the uppermost sheet on the processing tray.

(3) The means 83 positions the alignment surfaces 53*x* of the single-sheet alignment means 52 (side edge alignment members 53) in the waiting positions separated from the sheet side edges.

(4) The means 83 shifts the alignment surfaces 51*x* of the loaded sheet alignment means 38, guide surfaces 46*x* of the divider guide members 46, and sheet support surfaces 40*x* of the sheet discharge second rollers to positions to engage in the sheet.

The sheet discharge initial state is set by the aforementioned operation. The sheet discharge initial state is made by almost the same operation when either finish mode is selected. Next, in regard to sheet discharge operation, the case that the post-processing mode is selected will be described according to FIG. 14.

The control means 83 executes sheet discharge operation after setting the sheet discharge initial state. The operation is to carry the sheet fed to the sheet discharge path 31 from the back transport path 44 onto the processing tray, and sequentially stack sheets to collate and collect. Therefore, the control means 83 rotates the transport roller 36. To rotate the transport roller 38, the means 83 adopts either the method of starting the drive motor using a sheet discharge instruction signal or the method of starting using a signal such that the carry-in sensor Se1 detects the sheet front end.

Next, the control means 83 actuates the single-sheet alignment means 52 at timing (delay timer) at which the sheet rear end is released from the transport roller using a signal such that the carry-in sensor Se1 detects the sheet rear end. In the single-sheet alignment means 52, the pair of right and left side edge alignment members 53*a*, 53*b* as described previously approach the beforehand set reference line corresponding to the sheet size by rotation of the alignment motor M5.

At this point, in the sheet inside the path, the front end portion is carried out to the outside from the sheet discharge outlet 30, and the rear end portion is in a position released from the transport roller 36. At this point, the sheet is in a free state without being restrained by the roller or the like, shifts without curling by the shifts of the side edge alignment members 53 in the alignment direction, and is aligned with the reference line. In addition, in the sheet discharge rollers 40, the sheet discharge first rollers 40*a* are held in the waiting positions retracted upward.

Then, in tandem with the width-direction alignment of the sheet, the control means 83 rotates and drives the transport belt 59 in the sheet discharge direction. Then, the engagement hooks 58 provided in the belt engage in the sheet rear end to shift the sheet in the sheet discharge direction. At this point, even when the sheet is skewed, the skew is corrected. After thus actuating the single-sheet alignment means 52 and skew correction means 57, the control means 83 brings the sheet discharge rollers 40 in press-contact. The operation is to lower the sheet discharge first rollers 40*a* to the positions to engage in the sheet discharge second rollers (sheet discharge second rollers) 40*b*, and concurrently rotate in the direction opposite to the sheet discharge direction. At this point, the path switch means 45 deflects the posture so as to guide the sheet rear end from the sheet discharge path 31 to the branched back transport path 44 as shown in FIG. 8C.

Next, the means 83 shifts the position of the sheet press means 48 to a press state after a lapse of predicted time the sheet rear end is struck against the rear end regulation means 47 on the processing tray. This timing is set at predicted time the sheet rear end reaches the rear end regulation means 47, for example, using a signal such that the sheet discharge sensor Se2 detects the sheet rear end as a reference. Further, the sheet press means 47 is set for the pressing force with the actuator, not shown, and the biasing spring 50, to the extent that the paper press portion 48*a* presses the sheet to hold the posture.

In this state in which the sheet rear end is pressed and held, the means 83 retracts the divider guide members 46 and the sheet discharge second rollers 40*b* to the sheet lateral positions. In the Embodiment as shown in the figure, the operation is to shift the alignment surfaces 51*x* of the loaded sheet alignment means 38 to the waiting positions separated from the positions for engaging in the sheet side edges.

By executing such operation repeatedly, the predetermined number of sheets is collected on the processing tray. Then, when the control means 83 receives a job finish signal from the image formation unit A, the means 83 actuates the post-processing means 39 (for example, stapler apparatus). By the operation, the sheets on the processing tray are subjected to the post-processing (bookbinding processing in the apparatus shown in the figure).

Next, the control means 83 shifts the carrying-out roller 68 from the waiting position to the actuation position above the processing tray. Concurrently therewith, the means 83 rotates the sheet discharge rollers 40 in the sheet discharge direction. Then, the sheet bunch on the processing tray is carried out to the stack tray 33 on the downstream side while being nipped between the carrying-out roller 68 and sheet discharge second rollers 40*b*. By the above-mentioned operation, the sheets that are collated and collected on the processing tray are subjected to the post-processing by the post-processing means 39, and then, are collected and stored in the stack tray 39 on the downstream side by the carrying-out means.

In addition, in the present invention, for the "single-sheet alignment means 52" and "loaded sheet alignment means 38", it is naturally possible to adopt the same structure, as the mechanism for width-shifting the sheet in the transport orthogonal direction to align with the reference line. As the alignment mechanism, it is possible to adopt the mechanism of reciprocating by rotation of a single motor by an interlocking mechanism (rack-pinion interlocking mechanism or the like) for interlocking a pair of right and left alignment plates to shift in the opposite directions by the same amount, and also, driving a pair of right and left alignment plates using respective independent motors, and in this case, it is possible to perform jog transport for offsetting the sheet by a predetermined amount to carry to the stack tray on the downstream side.

The apparatus shown in the figure shows the configuration for driving the right and left alignment members 53 with individual drive motors in relation to offsetting the sheet in the transport orthogonal direction to jog-transport. Further, the loaded sheet alignment means 38 disposed on the processing tray 32 shows the configuration that the means 38 reciprocates between the waiting position separated from the sheet side edge and the alignment position for width-shifting and aligning the sheet.

It is also possible to configure the right and left side edge alignment members 51 so that the members 51 shift from the waiting positions to the alignment positions whenever the sheet is carried in the processing tray (every sheet carry-in). In this case, since the divider guide 46 and the sheet discharge second roller 40*b* are integrally attached to the side edge alignment member 51, the shift unit D is positioned in the alignment position when the sheet is carried in the processing tray 32, while shifting to the waiting position after carrying in the sheet, and returns and moves to the alignment position. The sheet is aligned by this return operation.

[Explanation of the Duplex Path]

Figure 16:
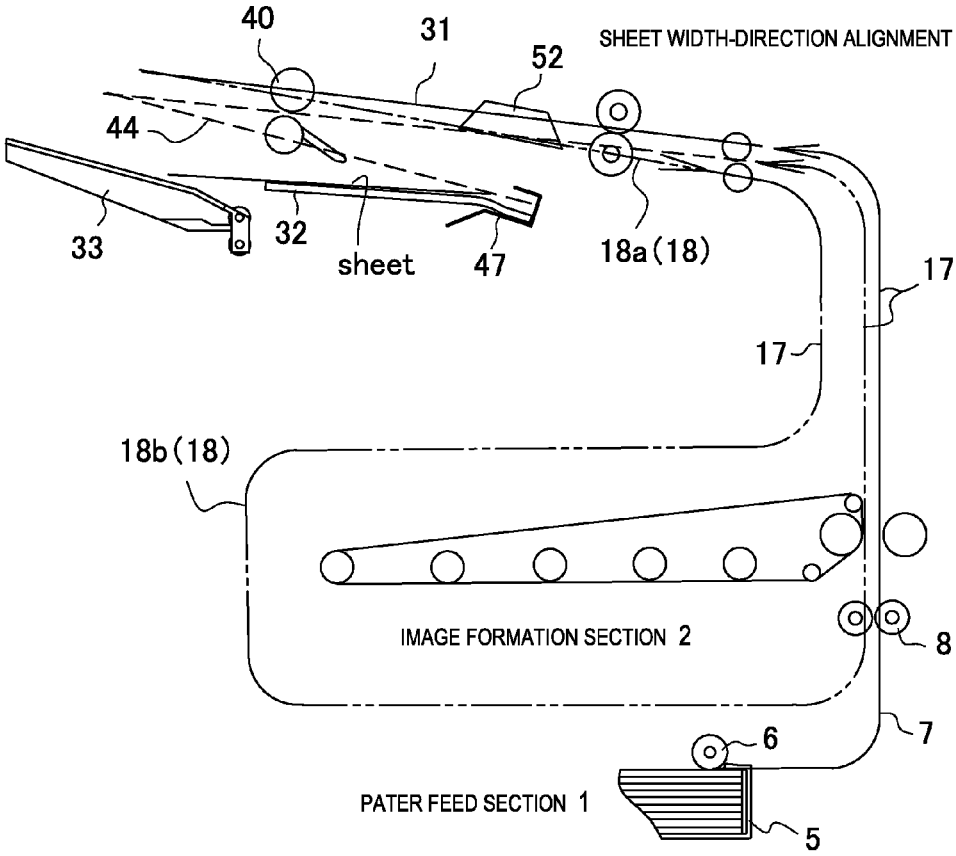
FIG. 16 is an explanatory view of a path configuration illustrating a sheet flow in image formation of one-side image and two-side images in the system of FIG. 1.

As described previously, the duplex path 18 is formed in the image formation unit A. The path is comprised of the switchback path 18*a* and the U-turn path 18*b*, the switchback path 18*a* reverses the transport direction of the sheet, and the U-turn path 18*b* is comprised of the path for reversing the frontside and backside of the sheet. As shown in FIG. 16, the duplex path 18 is connected to the second sheet discharge path 31 (post-processing section sheet discharge path; the same in the following description) coupled to the paper feed path 7, image formation section 2 and first sheet discharge path 17 (image formation section sheet discharge path; the same in the following description), and the sheet width-direction position is aligned by the single-sheet alignment means 52 as described previously disposed in the sheet discharge path 31 to match with the reference line.

Next, the sheet fed from the second sheet discharge path 31 is transported backward to the sheet discharge path 17 (that is the same path as the first sheet discharge path) of the image formation section 2. At this point, the front and back in the transport direction of the sheet are reversed, and the first sheet discharge path 17 and the second sheet discharge path 31 form the switchback path 18*a*. The U-turn path 18*b* is provided while being continued to the path, and the path end of the path guides the sheet to the register roller pair 8. In the sheet guided to this position, the frontside and backside are reversed, the image is formed on the backside of the sheet in the image formation section 2, and then, the sheet is carried out to the first sheet discharge path 17. Then, the sheet is guided to the second sheet discharge path 31 of the post-processing unit C via the main-body sheet discharge outlet 16.

In addition, in the apparatus as shown in the figure, the single-sheet alignment means 52 and skew correction means 57 are disposed in the sheet discharge path 31 of the post-processing unit C, and wait while retracting from the sheet discharge path 31. Thus, in the present invention, the sheet is guided to the sheet discharge path 31 to correct the width-direction posture, and then, is returned to the image formation unit A. At this point, the control means 83 described later is characterized by controlling the skew correction means 57 of the sheet discharge path 31 on the post-processing unit side to the non-actuation state, and when the sheet that is fed again from the image formation unit A is fed to the processing tray 32 via the sheet discharge path 31, controlling the skew correction means 57 to the actuation state.

Then, the sheet with the images formed on both the frontside and the backside is carried to the sheet discharge path 31 of the post-processing unit C via the sheet discharge path 17 of the image formation unit A. In this path, the posture is corrected by the operation as described previously in the sheet width-direction by the single-sheet alignment means 52, and the front and back in the transport direction by the skew correction means 57. Subsequently, the posture-corrected sheet is struck against the rear end regulation means 47 of the processing tray 32 via the back transport path 44 and is aligned. Then, after the sheet rear end is regulated in the position, the sheet front end side drops onto the processing tray 32 and is stored.

[Duplex Control]

Described next is operation in two-side image formation for forming images on the frontside and backside of the sheet in the above-mentioned image formation. As in one-side image formation as described previously, the control CPU 73 in image formation feeds out a sheet of the designated size from the paper feed section 5 according to set image formation conditions, and feeds the sheet to the register roller pair 8 in the paper feed path 3 to cause the sheet to wait in this position.

Next, the control CPU 83 reads out image data transferred from the outside or from a storage apparatus prepared inside to output to a control section of the laser emitter 10. Then, the emitter 10 forms a latent image on the drum surface, ink is added to the image, and the charger 13 forms the image on the sheet. The sheet undergoes fusing in the fuser (heat roller) 14, and is fed to the main-body sheet discharge outlet 16. Next, the sheet is fed to the sheet discharge path 31 of the post-processing unit C from the carry-in entrance 34 coupled to the main-body sheet discharge outlet 16.

Meanwhile, the control CPU 83 of the post-processing unit C receives a command signal of the "two-side image formation mode" from the control section 73 of the image formation unit A. Then, when the carry-in sensor Se1 of the carry-in entrance 34 detects the sheet front end, the control CPU 83 rotates the transport roller 36 in the sheet discharge direction (or the roller rotates using a sheet discharge instruction signal). Then, the sheet is carried into the sheet discharge path 31, and when the sheet discharge sensor Se2 detects the sheet rear end, a timer is actuated. The timer is set for predicated time the alignment operation is finished after the sheet rear end passes through the sheet discharge sensor Se2.

The control means (control CPU 83; the same in the following description) actuates the single-sheet alignment means 52 using a detection signal such that the sheet rear end passes through the carry-in sensor Se1, and matches the width-direction position of the sheet with the reference line. At this point, in the sheet discharge rollers 40, the sheet discharge first rollers 40*a* are retracted upward. Then, the control means 83 lowers the sheet discharge first rollers 40*a* to the press-contact state after the end of the delay time of the timer. In tandem therewith, the means 83 rotates the sheet discharge first rollers 40*a* backward in the opposite direction to the sheet discharge direction. Then, the sheet reveres the transport direction toward the main-body sheet discharge outlet 16 (switchback transport).

Concurrently with backward rotation of the sheet discharge rollers, the control means 83 also rotates the transport roller 36 backward to guide the sheet to the main-body sheet discharge outlet 16. The sheet is carried in the main-body sheet discharge path 17 of the image formation unit A from the main-body sheet discharge outlet 16, and is fed to the U-turn path 18*b* coupled via the path switch means 20. The sheet is fed from this path to the register roller pair 8 of the image formation section 2, and waits in this position. Then, the control CPU 73 forms an image on the sheet backside based on the image data of the backside to carry out to the main-body sheet discharge outlet 16.

The sheet with the images formed on both the frontside and backside is fed to the main-body sheet discharge outlet 16, and is transferred to the post-processing unit C. Subsequently, the sheet is processed as in the operation as described previously, undergoes the post-processing in the processing tray 32, and is stored in the stack tray 33.

In addition, it is possible to adopt system control such that for "color copy paper" requiring high accuracy of image formation, the sheet undergoes width alignment by the side edge alignment means 53 and then, is shifted to the image formation unit side for the duplex processing, and that for "monochrome copy paper" with relatively low image accuracy, the sheet is shifted to the main-body apparatus side for the duplex processing without undergoing width alignment by the side edge alignment means 53.

In addition, this application claims priority from Japanese Patent Application No. 2012-019972, Japanese Patent Application No. 2012-019971, and Japanese Patent Application No. 2012-019973 incorporated herein by reference.

The invention claimed is:

1. A sheet post-processing apparatus comprising:

a sheet discharge path having a carry-in entrance and a sheet discharge outlet;

a transport roller disposed in the sheet discharge path;

a processing tray disposed below the sheet discharge outlet with a height difference formed;

a back transport path for reversing a transport direction of a sheet to transport from the sheet discharge path to the processing tray;

sheet discharge rollers disposed in the sheet discharge outlet to carry the sheet fed from the carry-in entrance to the back transport path:

sheet guide means for guiding the sheet fed by the sheet discharge rollers to the processing tray so as to form the back transport path;

post-processing means disposed in the processing tray;

sheet side edge alignment means disposed in the processing tray to align a width-direction position of the sheet with a beforehand set reference line; and a common drive motor, wherein the sheet guide means is comprised of a pair of right and left guide members having guide surfaces capable of shifting to positions in a carry orthogonal direction of the sheet carried to the processing tray, the sheet side edge alignment means is comprised of a pair of right and left side edge alignment members having alignment surfaces for sheet side edges capable of shifting to positions in a sheet-discharge orthogonal direction of the sheet, and the common drive motor is configured to shift the guide members and the side edge alignment members to positions in the sheet-discharge orthogonal direction in an integral manner.

2. The sheet post-processing apparatus according to claim 1, wherein among the sheet discharge rollers, rollers that contact an underside of the sheet shifting in the back transport path are comprised of movable rollers capable of shifting to positions in the sheet-discharge orthogonal direction, and the movable rollers are disposed as a pair to the right and left of the sheet that is transported backward.

3. The sheet post-processing apparatus according to claim 2, wherein the pair of right and left guide members and the movable rollers are disposed in a position relationship that each of the guide members guides the sheet toward the processing tray when the movable rollers are in positions for engaging in the sheet, while being disposed in a relationship that each of the alignment members is positioned in a waiting position of alignment operation for width-shifting side edges of the sheet that is carried onto the processing tray when the movable rollers are in positions retracted from the sheet.

4. The sheet post-processing apparatus according to claim 2, wherein the movable rollers are supported rotatably by roller holders integrally formed respectively in the right and left guide members.

5. The sheet post-processing apparatus according to claim 4, wherein each of the right and left side edge alignment members formed as a pair and each of the right and left guide members formed as a pair are configured to be able to shift to positions in a sheet transport orthogonal direction in an integral manner.

6. The sheet post-processing apparatus according to claim 5, wherein the side edge alignment members and the guide members are formed by integral forming of synthetic resin, and the movable rollers are axially supported rotatably by the roller holders integrally formed in the guide members.

7. The sheet post-processing apparatus according to claim 1, wherein in the alignment surfaces of the side edge alignment members and the guide surfaces of the guide members, a distance between right and left guide surfaces is set to be shorter than a distance between right and left alignment surfaces.

8. The sheet post-processing apparatus according to claim 1, further comprising:

control means for controlling the sheet discharge rollers, the sheet guide means and the sheet side edge alignment means, the guide members and the side edge alignment members are formed as pairs to the right and left of the sheet shifting in the back transport path, while the guide members and the side edge alignment members to the right and left are configured to be able to shift to positions in the carry orthogonal direction of the sheet in an integral manner, and the control means controls the common drive motor so that in the guide members and the side edge alignment members to the right and left, a distance between the right and left is increased in order of an alignment position, a guide position and a retracted position.

9. The sheet post-processing apparatus according to claim 1, wherein the sheet discharge path is provided with single-sheet alignment means for aligning a width-direction position of the sheet carried toward the sheet discharge outlet by the transport roller with a reference line.

10. The sheet post-processing apparatus according to claim 1, wherein in the sheet discharge path is provided skew correction means for corroding skew of front and back end edges of the sheet carried toward to the sheet discharge outlet by the transport roller.

11. An image formation system comprising:

an image formation unit that forms an image on a sheet; and a post-processing unit that performs post-processing on the sheet fed from the image formation unit, wherein the post-processing unit is provided with a configuration according to claim 1.

* * * * *